US010231538B2

(12) United States Patent
Zelek et al.

(10) Patent No.: US 10,231,538 B2
(45) Date of Patent: Mar. 19, 2019

(54) COLLAPSIBLE SHELVING UNIT

(71) Applicant: Rehrig Pacific Company, Los Angeles, CA (US)

(72) Inventors: John B. Zelek, Los Angeles, CA (US); Suzanne Whitfield Clark, Atlanta, GA (US); Ryan C. Meers, West Chester, PA (US)

(73) Assignee: Rehrig Pacific Company, Los Angeles, CA (US)

( * ) Notice: Subject to any disclaimer, the term of this patent is extended or adjusted under 35 U.S.C. 154(b) by 604 days.

(21) Appl. No.: 14/338,437

(22) Filed: Jul. 23, 2014

(65) Prior Publication Data

US 2015/0041420 A1 Feb. 12, 2015

Related U.S. Application Data

(60) Provisional application No. 61/940,807, filed on Feb. 17, 2014, provisional application No. 61/893,836, filed on Oct. 21, 2013, provisional application No. 61/863,871, filed on Aug. 8, 2013.

(51) Int. Cl.

| | |
|---|---|
| ***A47B 43/00*** | (2006.01) |
| ***A47B 47/00*** | (2006.01) |
| ***A47F 5/10*** | (2006.01) |

(52) U.S. Cl.

CPC ..... *A47B 43/00* (2013.01); *A47F 5/10* (2013.01)

(58) Field of Classification Search

CPC .. A47B 3/00; A47B 3/04; A47B 43/00; A47B 43/04; A47F 5/10

See application file for complete search history.

(56) References Cited

U.S. PATENT DOCUMENTS

| | | | | |
|---|---|---|---|---|
| 969,455 | A | 9/1910 | Braen | |
| 1,912,425 | A | 6/1933 | Baumer | |
| 2,649,350 | A | 8/1953 | Backus et al. | |
| 4,271,766 | A | 6/1981 | Schmiedeler | |
| 4,579,401 | A * | 4/1986 | Mears | A47B 43/00 312/258 |
| 4,618,115 | A | 10/1986 | Belokin, Jr. | |
| 5,027,961 | A * | 7/1991 | Howitt | A47B 87/0253 211/188 |
| 5,163,262 | A | 11/1992 | Adams | |

(Continued)

FOREIGN PATENT DOCUMENTS

| | | | | |
|---|---|---|---|---|
| DE | 102004041625 | A1 * | 4/2006 | A47B 43/00 |
| EP | 0469612 | A1 | 2/1992 | |

*Primary Examiner* — Stanton L Krycinski

(74) *Attorney, Agent, or Firm* — Carlson, Gaskey & Olds, P.C.

(57) ABSTRACT

A collapsible shelving unit includes a support base, a first side wall extending upwardly from one side of the base, and a second side wall extending upwardly from an opposite side of the base. Each of the first and second side walls are comprised of a plurality of rigid panels connected to each other with at least one hinge such that the rigid panels are moveable between a display position where the panels extend vertically to form the first and second side walls and a stowed position wherein at least two of the rigid panels at least partially overlap each other. A plurality of shelves are supported by the first and second side walls such that the shelves can be selectively removed therefrom.

31 Claims, 39 Drawing Sheets

(56) References Cited

U.S. PATENT DOCUMENTS 5,253,763 A * 10/1993 Kirkley ..... B65D 19/16 206/600
5,382,087 A * 1/1995 Pouch ..... A47B 73/00 160/135
6,123,207 A 9/2000 Mast
6,726,046 B2 4/2004 Orset
6,913,161 B2 7/2005 Schafer
7,134,230 B1 11/2006 Boens et al.
7,156,249 B2 * 1/2007 Heinrichs ..... B65D 7/28 220/4.28
7,537,121 B2 5/2009 Markson et al.
8,123,062 B2 2/2012 Tontarelli
8,256,629 B2 9/2012 Zhu et al.
8,342,347 B2 1/2013 Hay
8,453,854 B2 6/2013 Baran et al.
8,584,872 B2 11/2013 Eiseman
8,672,147 B2 3/2014 Lam
8,770,421 B2 * 7/2014 Hay ..... B65D 19/18 220/4.28
2006/0108899 A1 * 5/2006 Jin ..... A47B 43/00 312/257.1
2007/0051284 A1 * 3/2007 Shapiro ..... A47B 43/00 108/59
2007/0131633 A1 6/2007 Ferm
2008/0116201 A1 5/2008 Baltz
2009/0014445 A1 * 1/2009 Hay ..... B65D 19/18 220/6
2011/0084069 A1 * 4/2011 Hay ..... B65D 11/1866 220/4.28
2011/0180533 A1 * 7/2011 Hay ..... B65D 19/18 220/4.28
2012/0187118 A1 7/2012 Glenn
2013/0099642 A1 4/2013 Wehner et al.
2014/0027396 A1 1/2014 Landry

* cited by examiner

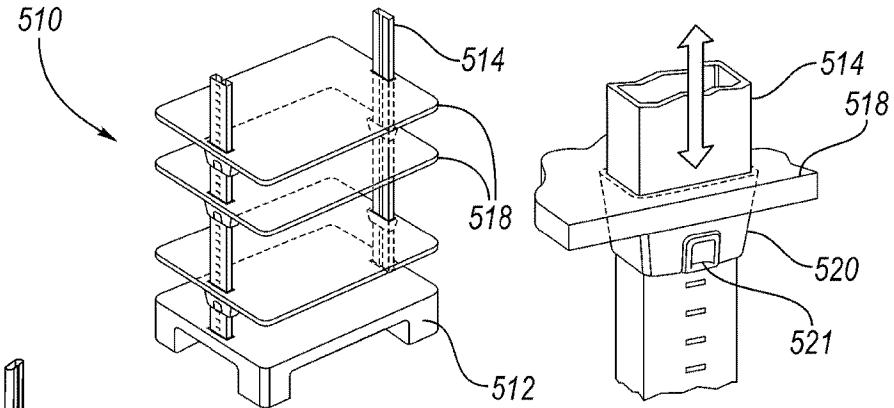
FIG. 52
FIG. 51
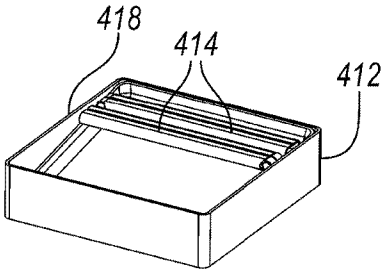
FIG. 50
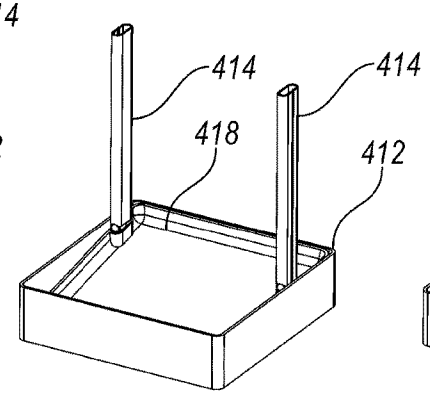
FIG. 49
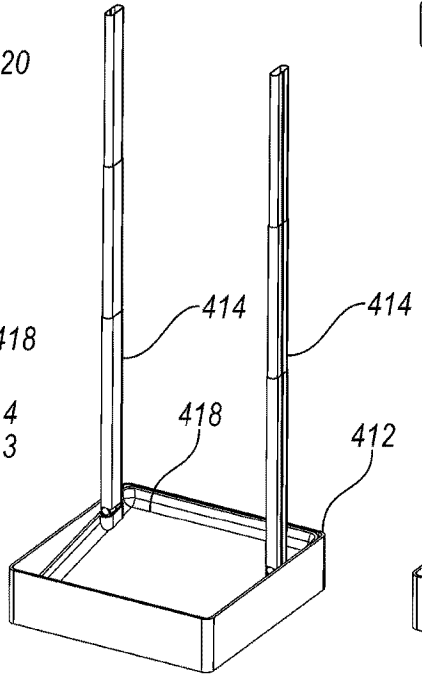
FIG. 48
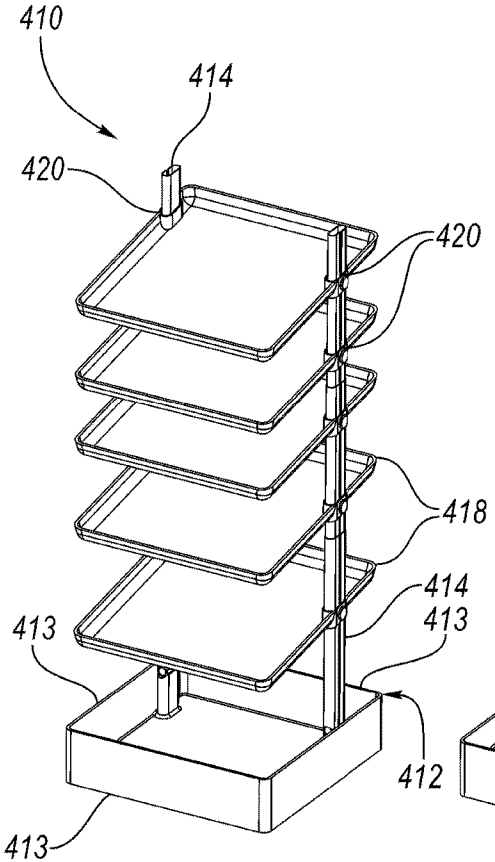
FIG. 47

COLLAPSIBLE SHELVING UNIT

CROSS-REFERENCE TO RELATED APPLICATIONS

This application claims priority to U.S. Provisional Application No. 61/863,871, filed Aug. 8, 2013; U.S. Provisional Application No. 61/893,836, filed Oct. 21, 2013; and U.S. Provisional Application No. 61/940,807, filed Feb. 17, 2014.

BACKGROUND

Shelving units are used to support goods for display in a store. The shelves must be kept stocked with the various goods, which can be time consuming. It would be beneficial to have goods ready to be displayed as soon as the goods arrive at the store without having store employees required to do the stocking.

SUMMARY

A collapsible shelving unit is movable between a display position, where goods are supported on shelves for display purposes, and a stowed or collapsed position.

In one example embodiment, the collapsible shelving unit comprises a support base, a first side wall extending upwardly from one side of the base, and a second side wall extending upwardly from an opposite side of the base. Each of the first and second side walls are comprised of a plurality of rigid panels connected to each other with at least one hinge such that the rigid panels are moveable between the display position where the panels extend vertically to form the first and second side walls and the stowed position wherein at least two of the rigid panels at least partially overlap each other. A plurality of shelves are supported by the first and second side walls such that the shelves can be selectively removed therefrom.

In another example, the collapsible shelving unit comprise a support base having a bottom with a first rigid side portion extending upwardly from one side of the bottom and a second rigid side portion extending upwardly from an opposite side of the bottom. A first vertical support is associated with the first rigid side portion and a second vertical support is associated with the second rigid side portion. Each of the first and second vertical supports are comprised of a plurality of collapsible members connected to each other such that each collapsible member is moveable between the display position where the collapsible members extend vertically to form the first and second side vertical supports and the stowed position wherein the collapsible members overlap each other for storage purposes. A plurality of shelves is supported by the first and second vertical supports.

In one example, the shelving unit is moved to the display position and the shelves of the shelving unit are stocked with goods. The shelving unit is then moved or shipped with the goods already on the shelves to a display area to display the goods, such as in a store for example. The shelving unit is then collapsed to the collapsed position when the goods are removed from the shelves. This allows the unit to be easily stored and/or returned to a vendor for reuse.

BRIEF DESCRIPTION OF THE DRAWINGS

FIG. 47 is a perspective view of another embodiment of a collapsible shelving unit.

FIG. 48 is a view of the embodiment of FIG. 47 showing the shelves in a collapsed position.

FIG. 49 is a view of the embodiment of FIG. 47 showing the posts in a collapsed position.

FIG. 50 is a view of the embodiment of FIG. 47 showing the posts in a storage position within the base.

FIG. 51 is a perspective view of another example of a shelving unit.

FIG. 52 is a magnified view of a collar from the unit of FIG. 51.

DETAILED DESCRIPTION

Figure 1:
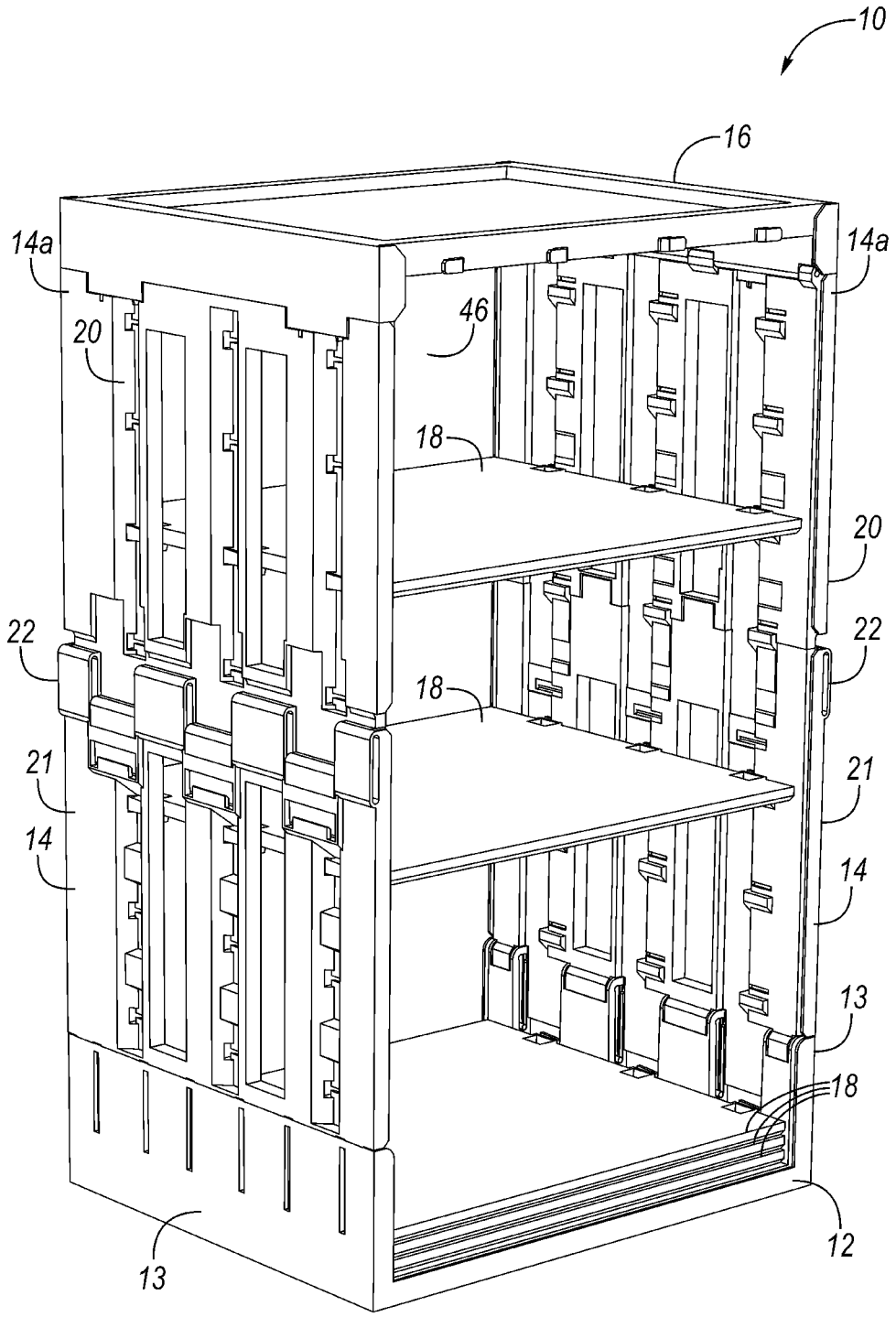
FIG. 1 is a front perspective view of one example of a collapsible shelving unit with shelves installed and in a display position.

A collapsible shelving unit 10 according to one embodiment is shown in FIGS. 1-17. Referring to FIG. 1, the unit 10 includes a support base 12 having integral upstanding side portions 13 and a pair of side walls 14 extending upward from the side portions 13. A cover or cap 16 is secured to upper edges 14*a* of the side walls 14. A plurality of shelves 18 are mounted to the side walls 14 and are vertically spaced from one another. Additional shelves 18 can be stored on the base 12 between the side portions 13 as needed (see FIG. 1).

Each side wall 14 includes a plurality of side panels 20, 21 connected by hinges 22. The unit 10 may include a rear wall 46 secured to the side walls 14. In the example shown in FIG. 1, each side wall 14 includes a lower side panel 21 and an upper side panel 20 that are connected to each other with hinges 22. Additional side panels 20, 21 could also be included to increase the height of the unit 10.

Figure 2:
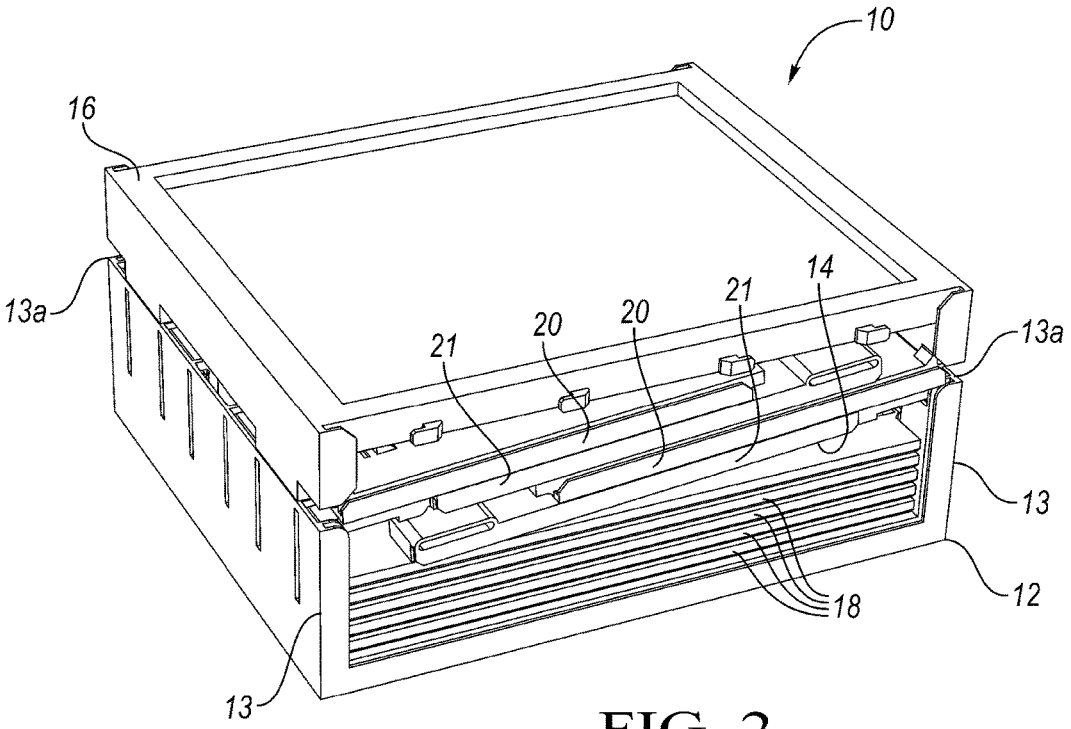
FIG. 2 is a front perspective view of the shelving unit of FIG. 1 in a collapsed position.
Figure 3:
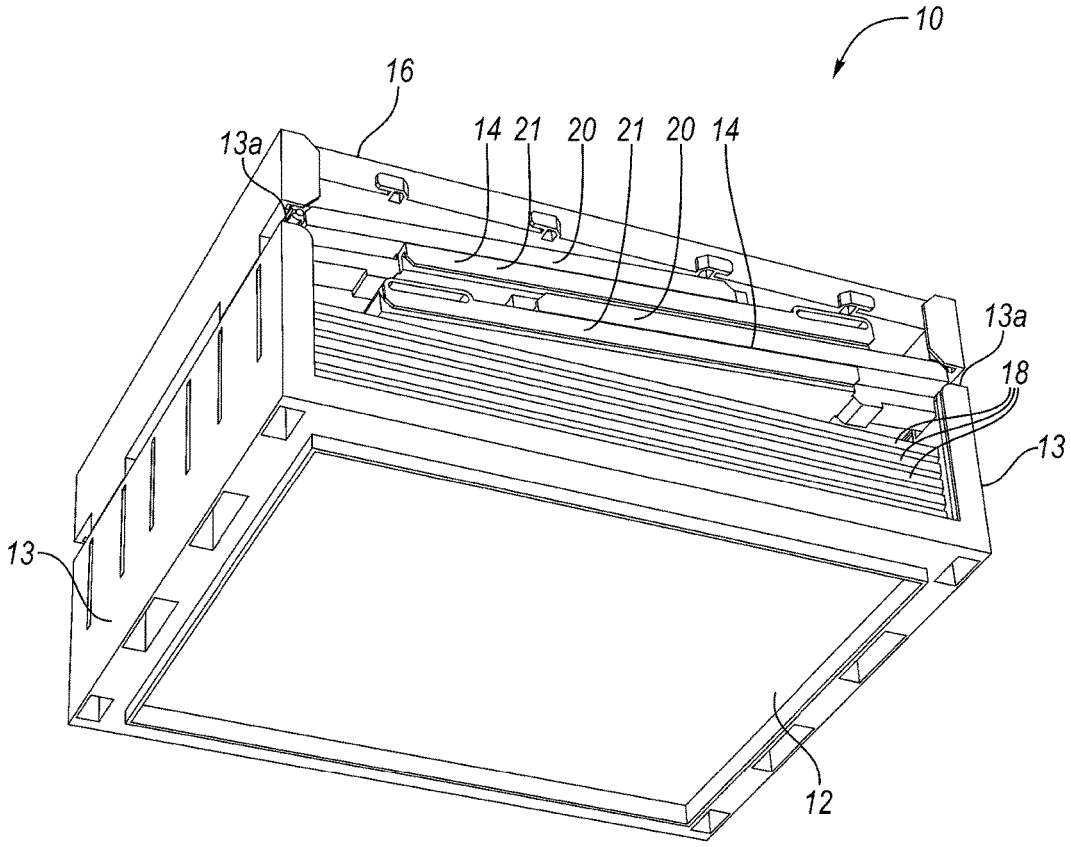
FIG. 3 is a bottom view of FIG. 2.

The unit 10 is moveable between a display position (FIG. 1), where goods can be placed on the shelves 18 for display, and a stowed or collapsed position. FIGS. 2 and 3 show the unit 10 with the side walls 14 and shelves 18 completely collapsed into the base 12. The shelves 18 and side walls 14 are received between the side portions 13 of the base 12. The cap 16 is secured to upper edges 13*a* of the side portions 13 of the base 12 to form a compact collapsed unit. The panels 20, 21 are pivoted relative to the side portions 13, the cap 16 and one another to collapse onto the base 12. When the panels 20, 21 are in the collapsed position, the panels 20, 21 overlap each other. Further, the collapsed panels 20, 21 have an overall side wall height that is less than or equal to a height of the side portions 13.

When moving the unit 10 to the collapsed position, the shelves 18 are first removed from the side walls 14 and are then stacked on top of each other on the base 12. The panels 20, 21 of the side walls 14 are then pivoted to the collapsed position (FIGS. 2-3) on top of the shelves 16. The cap 16 rests on the upper edges 13*a* to form the compact collapsed unit. When the plurality of shelves 18 are removed from the side walls 14 and are stacked on the base 12, and with the side panels 20, 21 collapsed on top of the stacked shelves 18, the height of the side portions 13 is the same as or slightly greater than a height of the stacked shelves 18 plus the overall height of the collapsed side walls 14 when in the stowed position.

Figure 4:
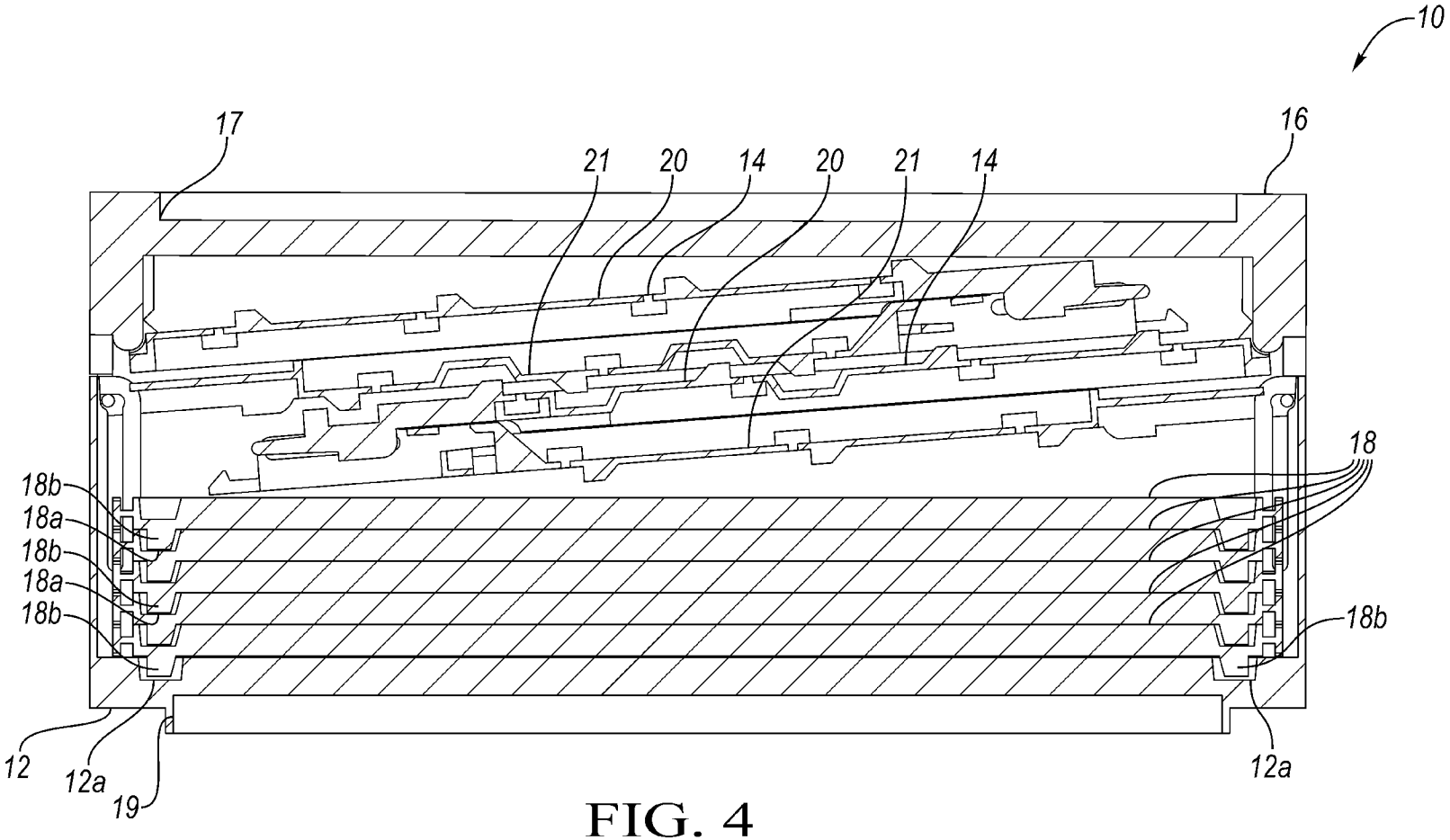
FIG. 4 is a cross-sectional view of FIG. 2.

FIG. 4 is a section view through the collapsed unit 10 of FIGS. 2 and 3. As described above, the shelves 18 are placed on the base 12 between the side portions 13 and the panels 20, 21 are collapsed onto the shelves 18. The cap 16 is fixed to the side portions 13 above the side walls 14. The shelves 18 can include corresponding recesses 18*a* and protrusions 18*b* that nest within each other when the shelves 18 are in the stacked position. This will prevent the shelves 18 from moving relative to each other when in the collapsed position. The base 12 may also include recesses 12*a* to receive protrusions 18*b* from the bottommost shelf 18.

In the example shown, the cap 16 includes a recess 17 formed in an upper surface of the cap 16. The base 12 includes a flange or rail 19 that extends vertically downwardly from a bottom surface of the base 12. The rail 19 from one unit 10 is located within the recess 17 of another unit 10 to allow two collapsed units to be stacked on top of each other for shipping or storage purposes. This will be discussed in greater detail below.

Figure 5:
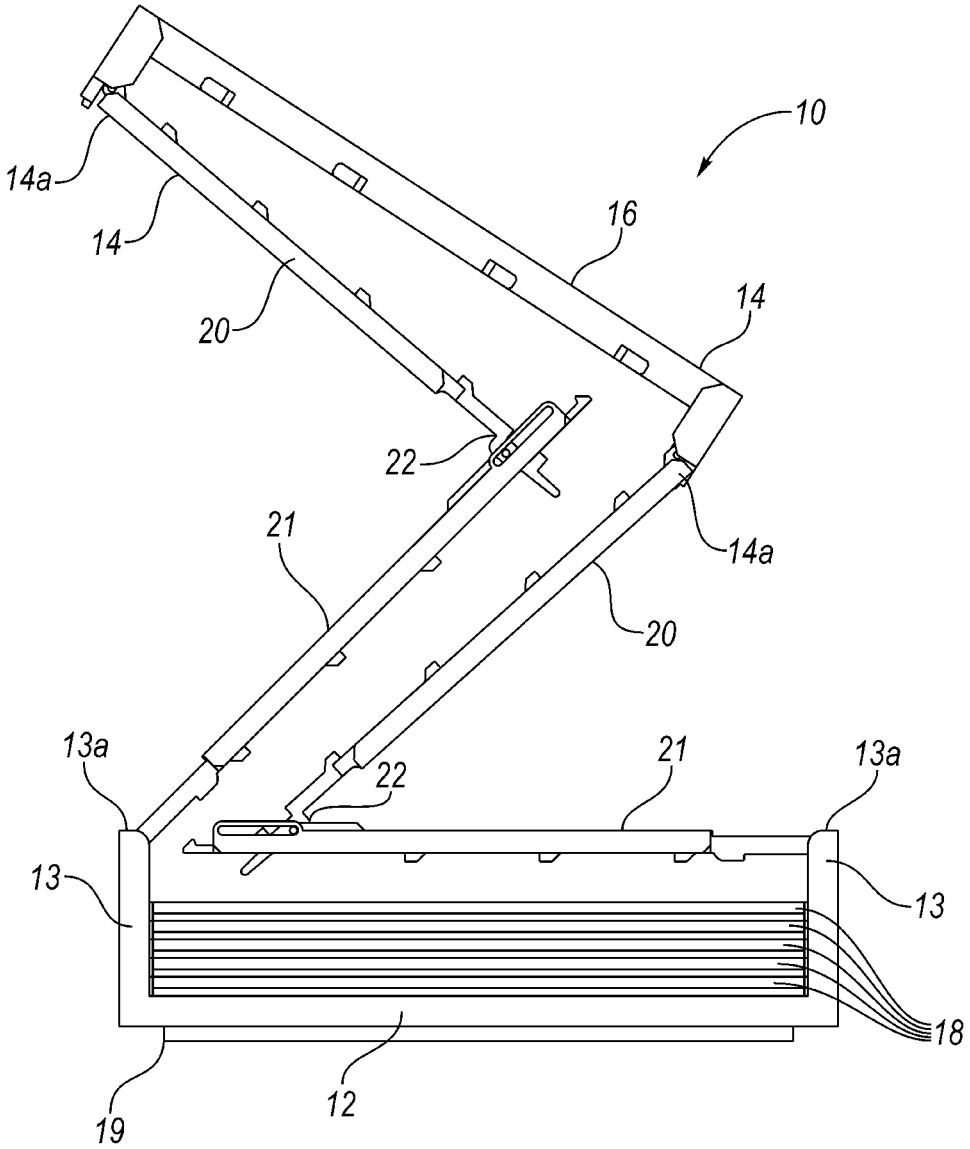
FIG. 5 is a front view of the unit of FIG. 1 in a partially collapsed position.

FIG. 5 is a front view of the unit 10 in a first step of being assembled. The cap 16 is lifted from the base 12, thereby lifting the upper side panels 20, which in turn lift the lower side panels 21. The upper side panels 20 pivot relative to the cap 16 and relative to the lower side panels 21. The lower side panels 21 pivot relative to the upper side panels 20 and relative to the side portions 13 of the base 12.

Figure 6:
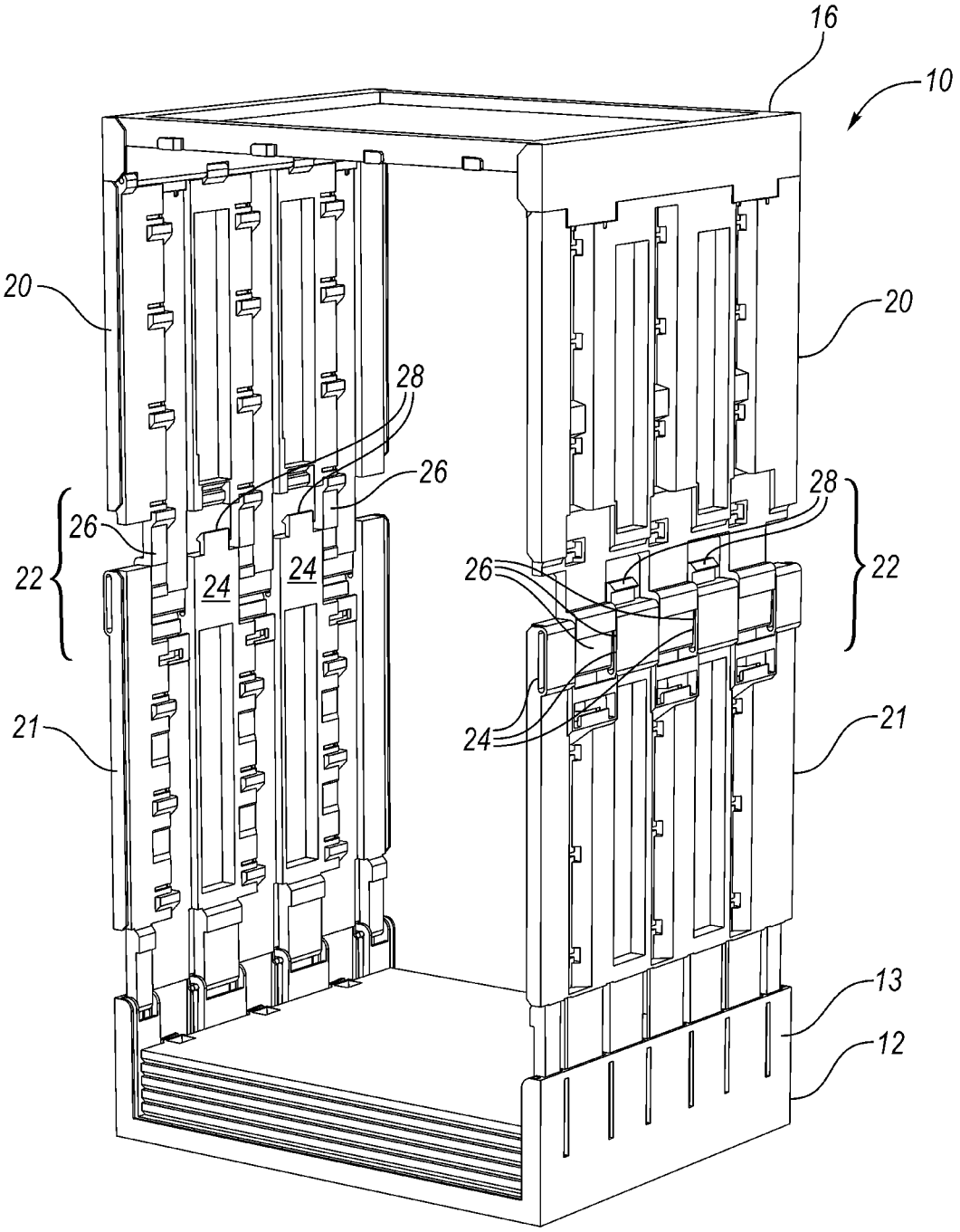
FIG. 6 is a front perspective view of one example of a collapsible shelving unit with the shelves removed and the panels unlatched relative to each other.
Figure 7:
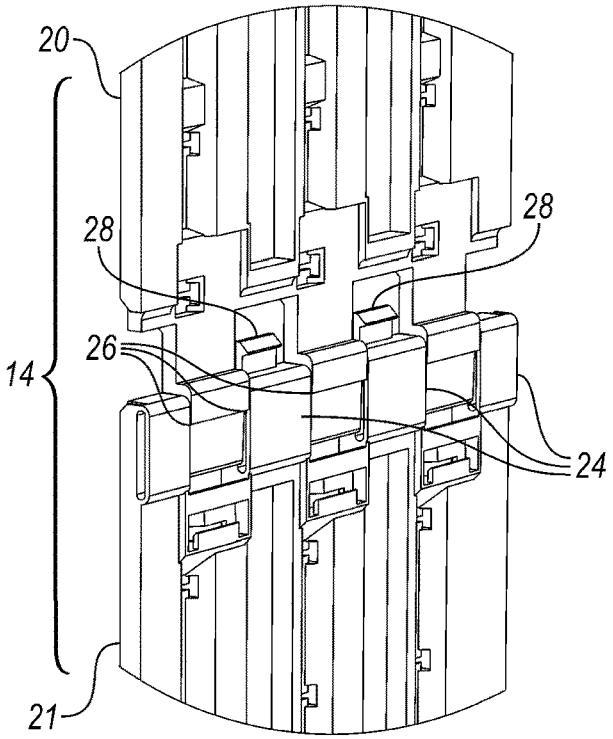
FIG. 7 is a magnified view of a hinge connection between panels.

FIG. 6 shows the side walls 14 in an upright position, but not fully locked or assembled. The lower side panels 21 include first hinge portions 24. The upper side panels 20 include second hinge portions 26 for slidably and pivotably connecting to the first hinge portions 24 of the lower side panels 21 to form the hinges 22. At least some of the first hinge portions 24 also include snap-fit connectors 28 at distal ends, as shown in FIGS. 6 and 7. Optionally, the second hinge portions 26 could include additionally include snap-fit connectors, or, could include snap-fit connectors instead of the first hinge portions 24.

FIG. 7 shows a magnified view of the first 24 and second 26 hinge portions. The first hinge portions 24 are interspaced with the second hinge portions 26 in an alternating arrangement. Thus, one of the second hinge portions 26 is positioned in a space between two first hinge portions 24, for example. The first hinge portions 24 and the second hinge portions 26 hingeably connect to form hinge 22, which allows the upper 20 and lower 21 panels to pivot relative to each other. In one example, the hinges 22 are formed such that they pivot only in the alternating directions as shown in FIG. 5. The snap-fit connectors 28 of the first hinge portions 24 will snap into an opening and/or over a ledge on the upper side panels to lock the panels 20, 21 together for the display position. This will be discussed in greater detail below.

Figure 8:
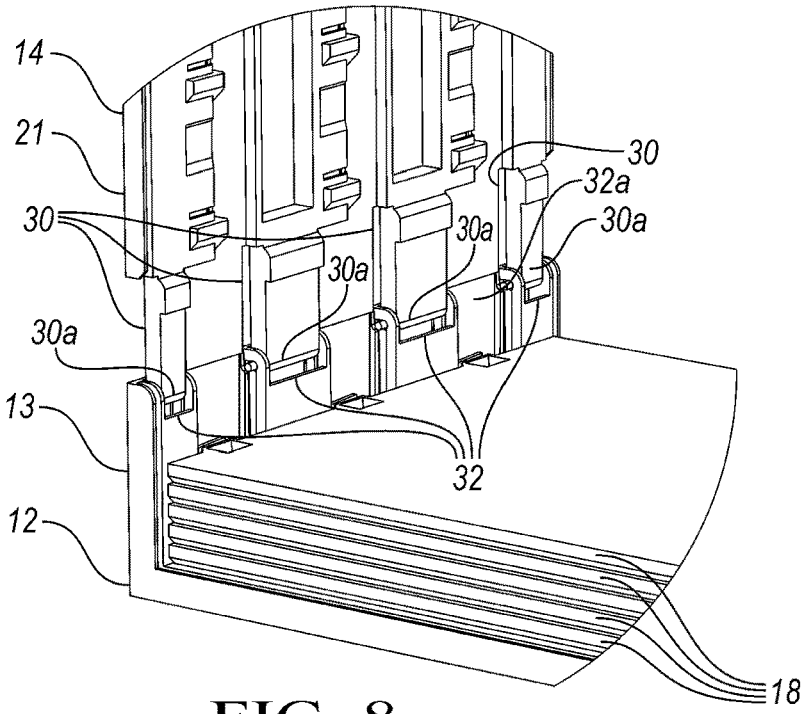
FIG. 8 is a magnified view of a connection between a side panel and a base.

Referring to FIG. 8, the lower side panels 21 include downward projecting leg portions 30 that hingeably and slidably connect at lower ends 30*a* to receptacles 32 formed in the side portions 13 of the base 12. The receptacles 32 are formed on inwardly facing surfaces 32*a* of the side portions 13. In one example, the receptacles 32 comprise discrete pockets that are open at an upper end to receive the lower ends 30*a* of the leg portions 30.

Figure 9A:
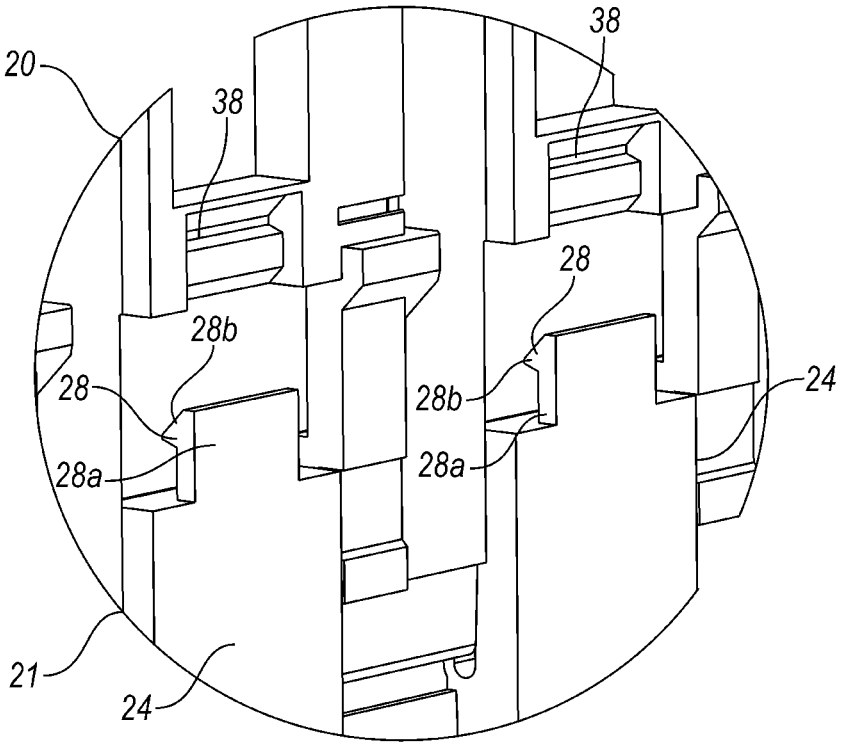
FIG. 9A is a magnified view of a snap-fit connector between side panels in an unlatched position.

FIG. 9A is an enlarged view showing the snap-fit connectors 28 of FIG. 7 in greater detail. The snap-fit connectors 28 extend upwardly from an upper edge of the first hinge portions 24. The connectors 28 include a reduced size neck portion 28*a* and a transversely extending snap-tab 28*b* at an upper end of the neck portion 28*a*. The snap-tab 28*b* extends outwardly in an external direction relative to the unit 10. An inwardly facing surface of the upper side panel 20 includes a snap-fit recess 38 for each snap-fit connector 28. In one example, the recesses 38 are formed to have a shape that is complementary to the shape of the snap-tabs 28*b*. The snap-fit connectors 28 snap into the recesses 38 (FIG. 9B) when the side panels 20, 21 are extended to a complete upright position for display purposes.

Figure 10:
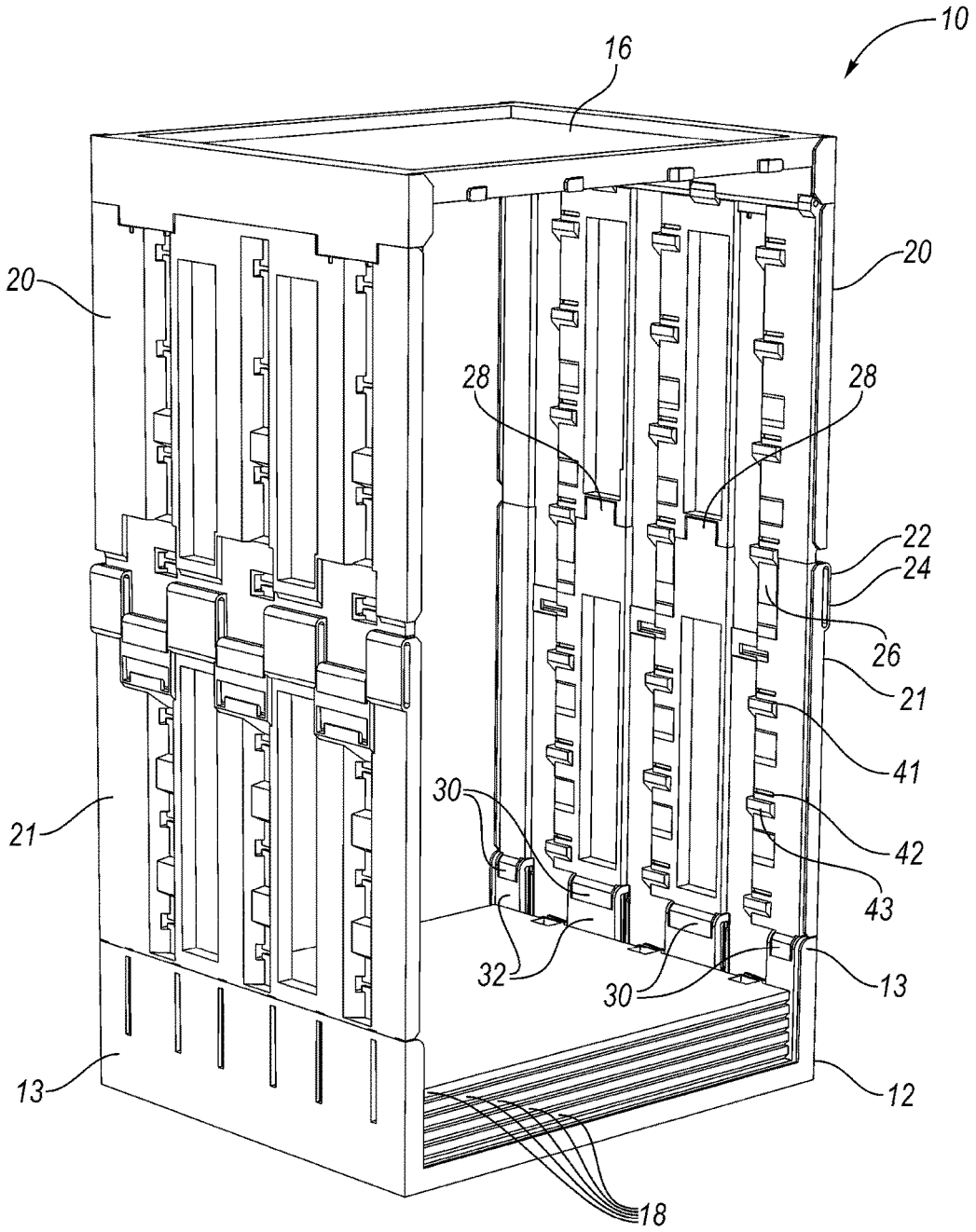
FIG. 10 is a view similar to FIG. 6 but with the side panels latched to each other.

FIG. 10 shows leg portions 30 of the lower side panel 21 after the leg portions 30 have been slid down into the receptacles 32 of the base 12, thereby securing the lower side panel 21 in an upright position. The upper side panel 20 is slid down partially into the lower side panel 21 (via slidable hinges 22) until the snap-fit connectors 28 slide into the recesses 38 to secure the upper panel 20 in the upright position.

Figure 9B:
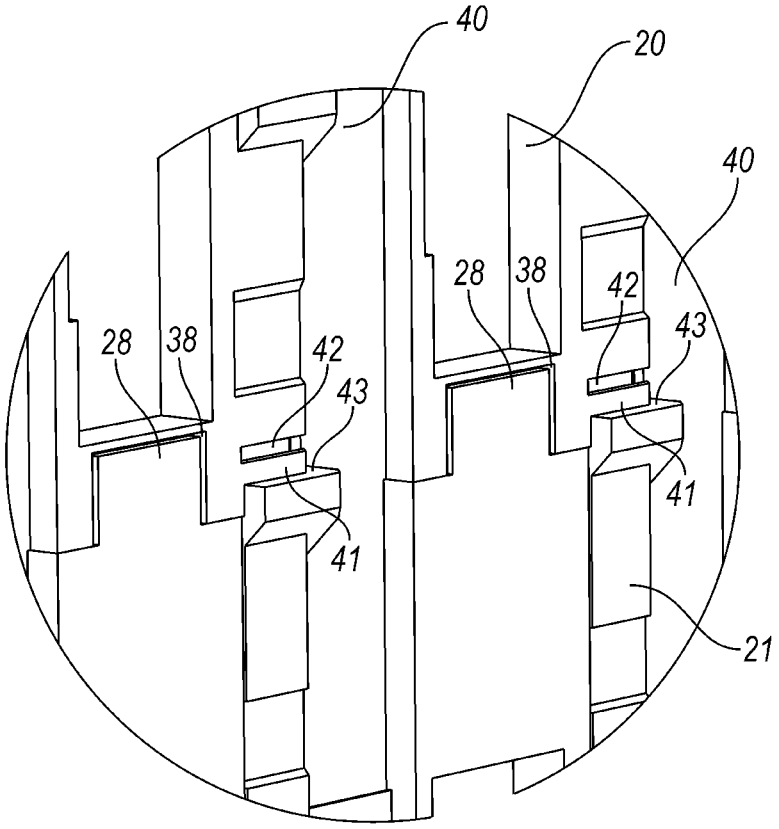
FIG. 9B shows the connectors of FIGS. 9A in a latched position.

As shown in FIG. 9B, the snap-fit connectors 28 of the lower side panel 21 snap-fit to the recesses 38 of the upper side panel 20. Also, the panels 20, 21 of the side walls 14 each include a plurality of vertical channels 40 and a plurality of slots 42 extending from each of the channels 40 above a corresponding support platform 43. A vertical channel 40 of the upper panel 20 is aligned with a corresponding vertical channel 40 of the lower panel 21. The slots 42 are formed within corresponding inwardly facing surfaces of the panels 20, 21 and are vertically spaced apart from each other. An extension 41 facilitates the formation of each slot 42. Each extension 41 rests on an upper surface of the corresponding support platform 43.

Figure 11:
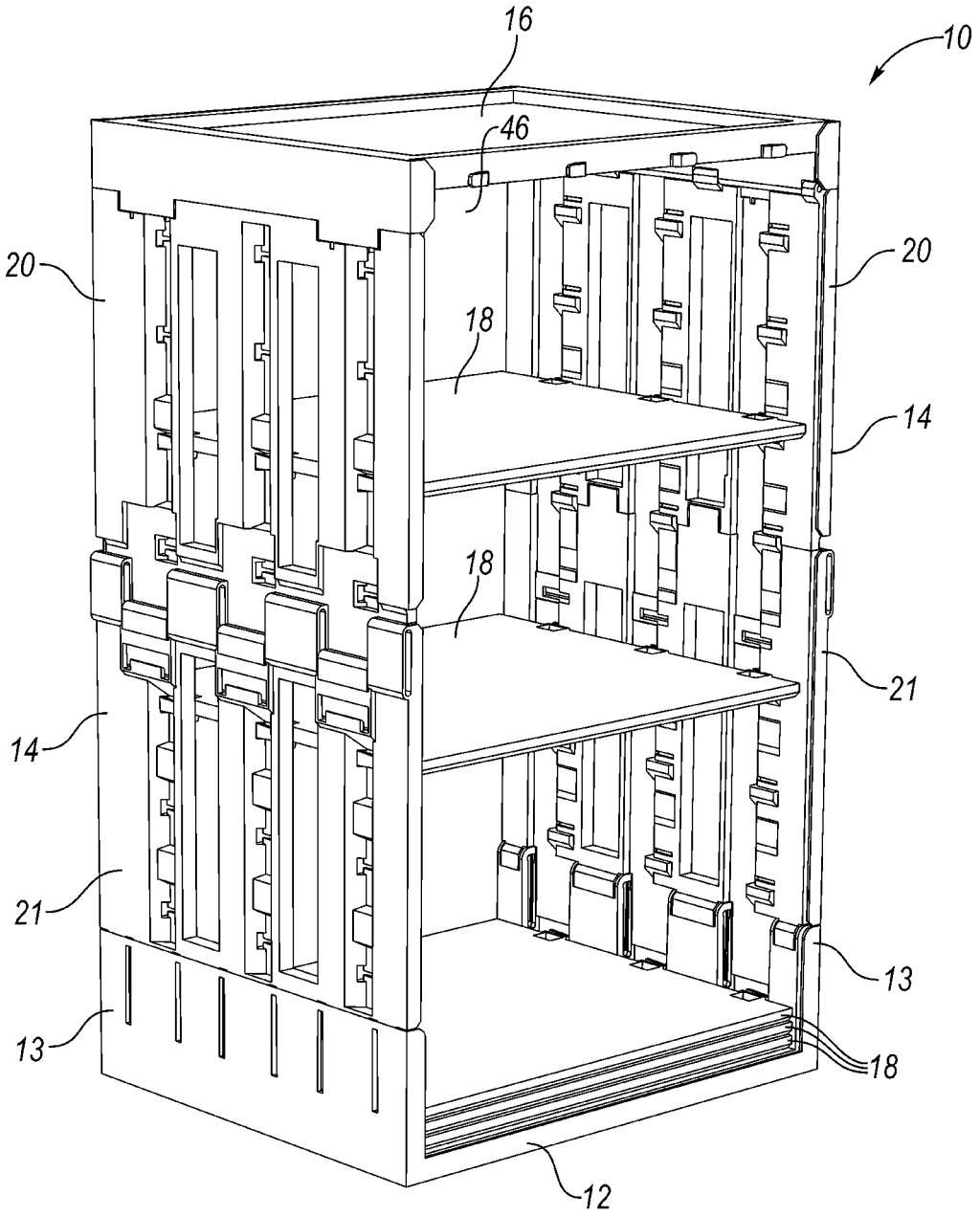
FIG. 11 is similar to FIG. 10 but includes the shelves.
Figure 12:
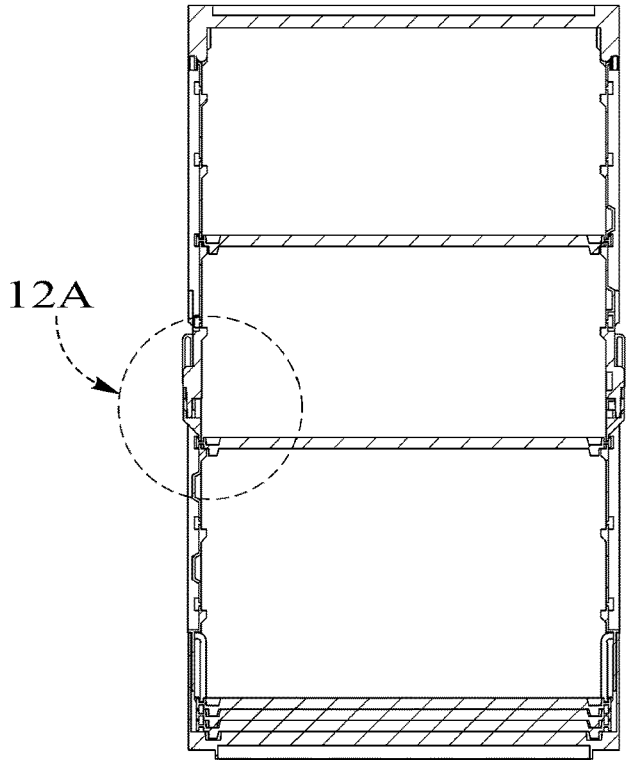
FIG. 12 is a front section view of the unit.
Figure 12A:
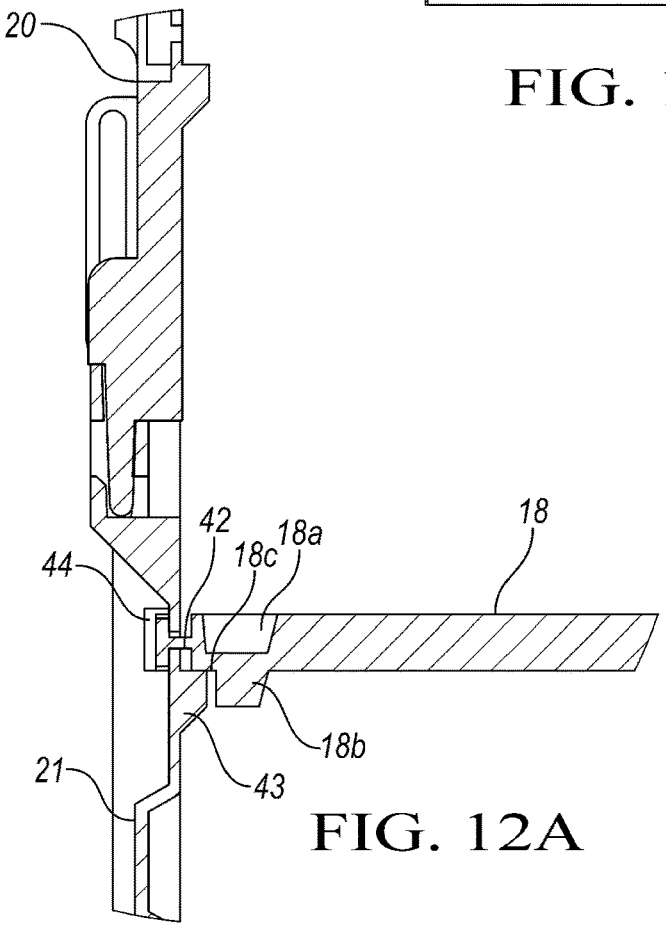
FIG. 12A is a section view of a shelf attached to a side panel as indicated in FIG. 12.

FIG. 11 shows two of the shelves 18 installed into unit 10. Referring to FIG. 12, the shelves 18 each include a slidable connector 44 having a T-shaped cross section, such that the connector 44 can be slid from the channel 40 into the slot 42. The connectors 44 are formed on opposing edges of the shelves 18. When the shelves 18 are installed, a lower surface 18*c* of the shelves 18 that is outboard of the protrusions 18*b* rests on the platforms 43 to securely hold the shelves 18 in place.

Figure 13:
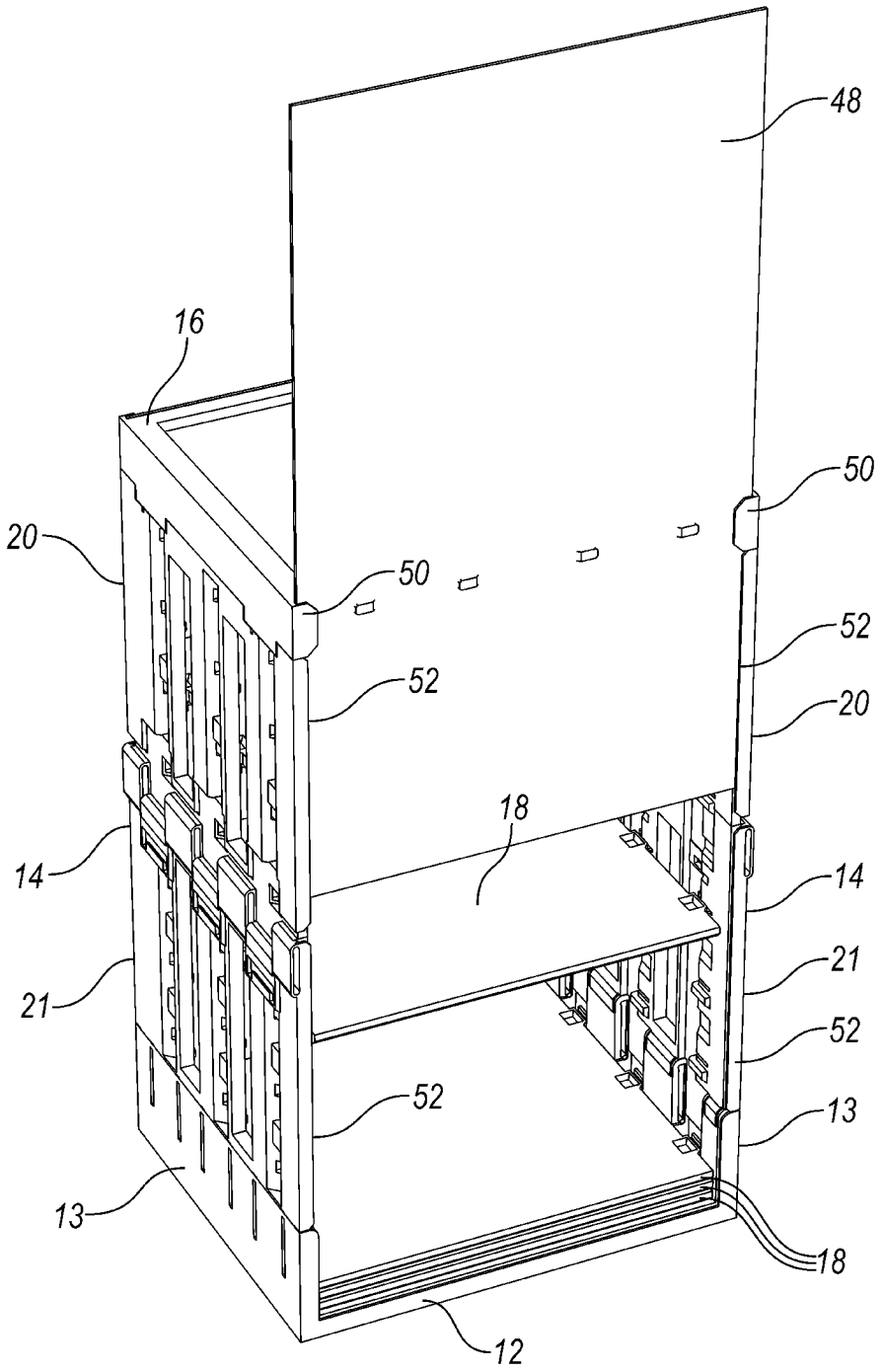
FIG. 13 is a front perspective view showing a front panel partially installed.
Figure 14:
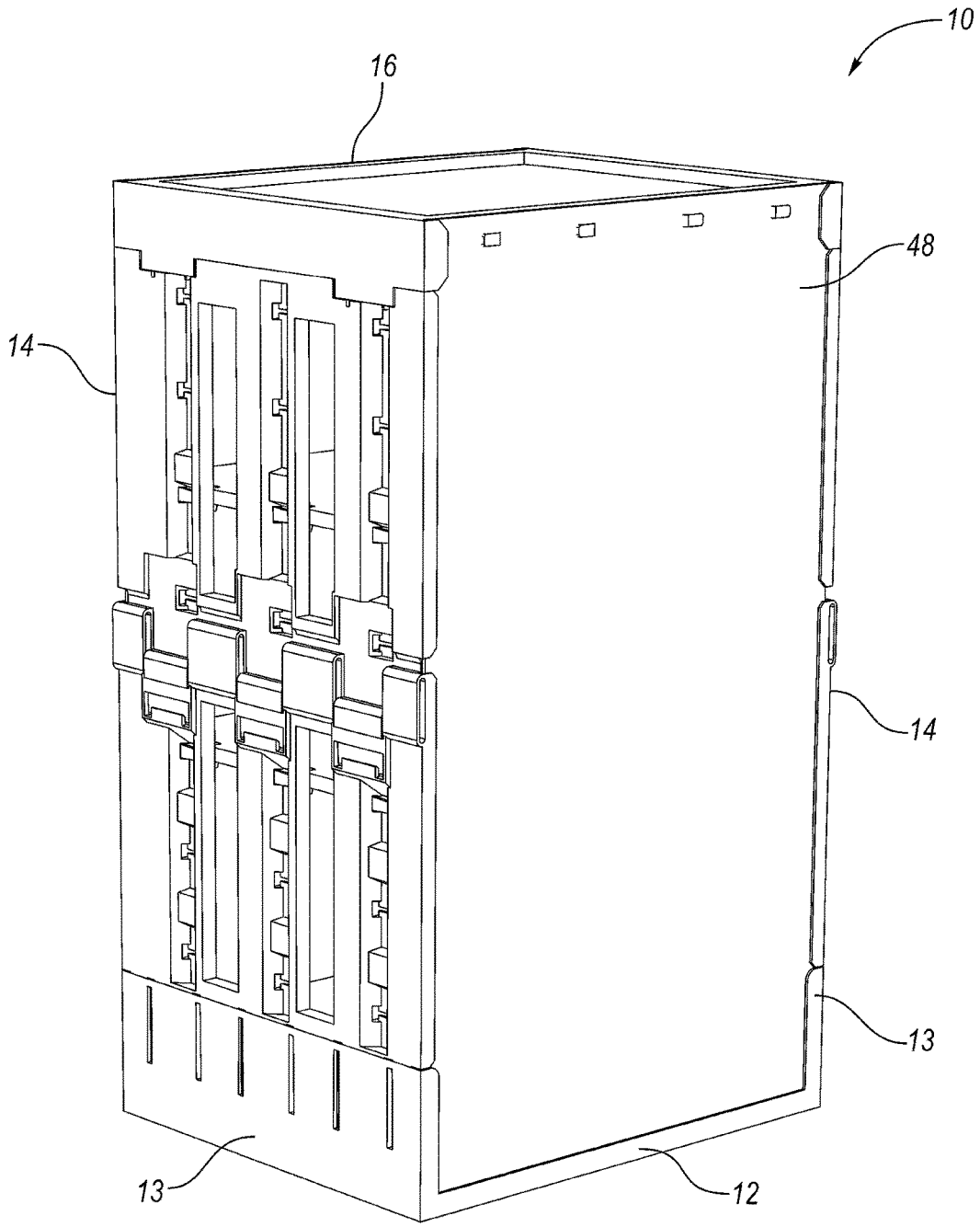
FIG. 14 is a view similar to FIG. 13 but with the front panel fully installed.

As shown in FIG. 13, a front panel 48 can optionally be slid through a slot defined by taps 50 in the cap 16 and down through channels defined by flanges 52 at the outer ends of the side walls 14. The front panel 48 can be inserted before shipping (FIG. 14) and can be removed in the store.

In use, goods for sale are placed on the shelves 18 on several shelving units 10, which are then placed on a pallet. When front 48 (FIG. 14) and rear 46 (FIG. 1) panels are installed, the goods remain securely on the shelves 18 during transport. The pallet and shelving units 10 are then delivered to a store and placed on the floor. Customers can view and select the goods directly from the shelves 18 once the front panel 48 is removed. When empty, the shelves 18 are removed and the side walls 14 are collapsed onto the base 12. The collapsed shelving units 10 are then returned to the distribution facility for reuse.

Figure 15:
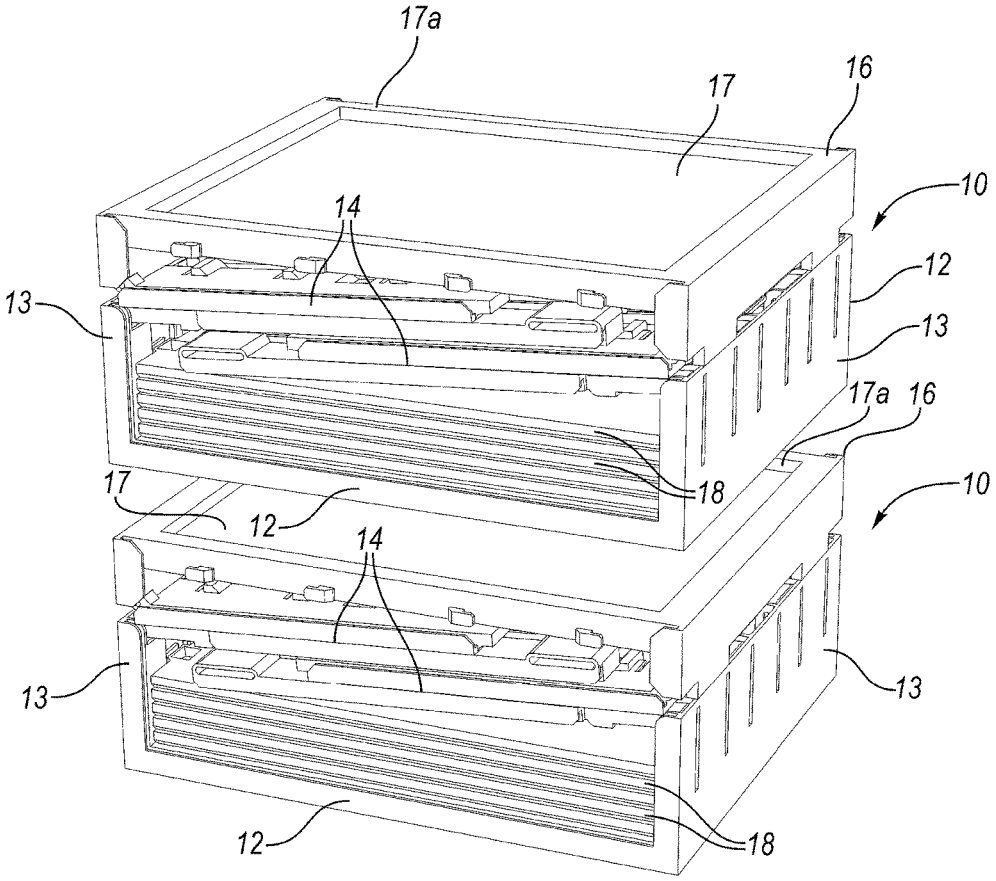
FIG. 15 is a front perspective view of stacking features for two shelving units.
Figure 16:
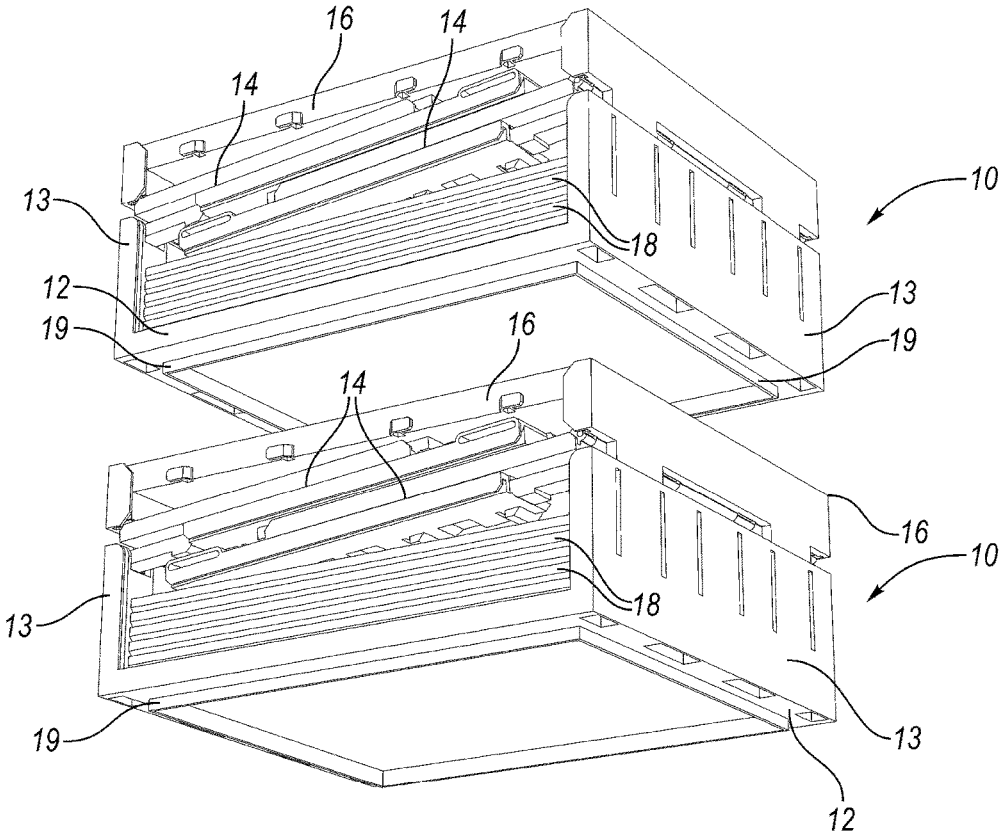
FIG. 16 is a bottom view of FIG. 15.
Figure 17:
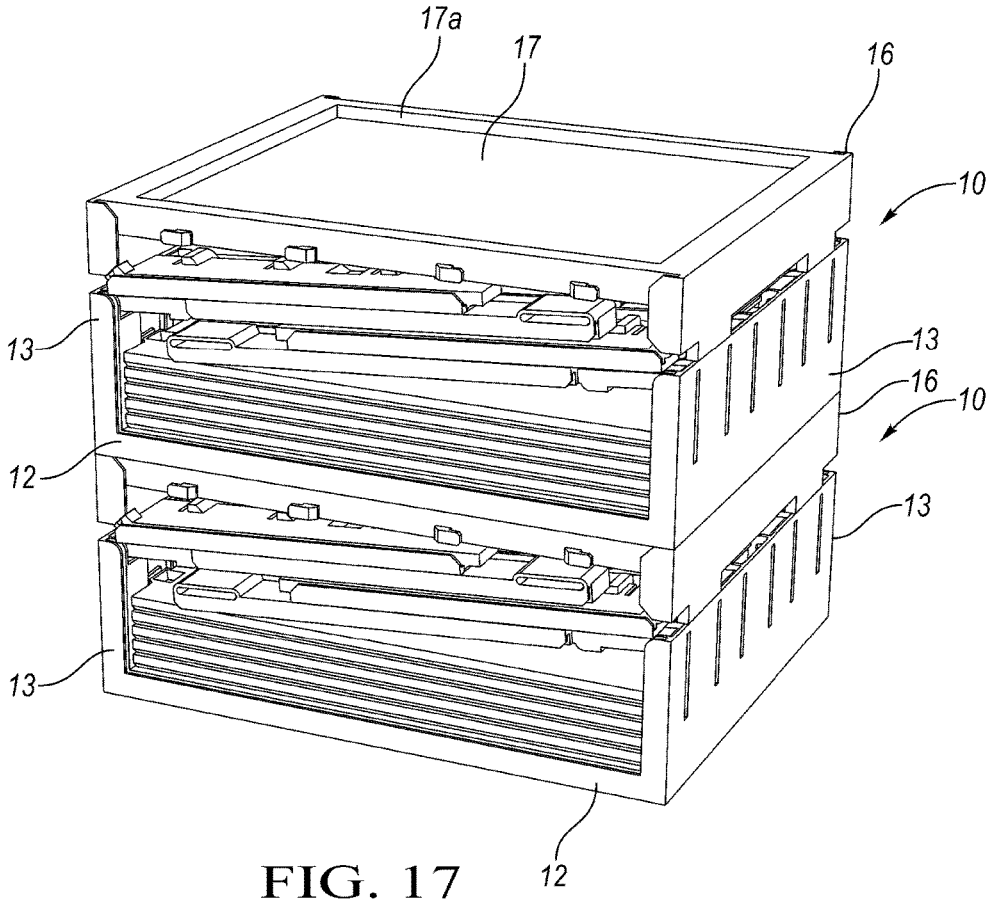
FIG. 17 shows the units of FIG. 15 stacked on top of each other.
Figure 18:
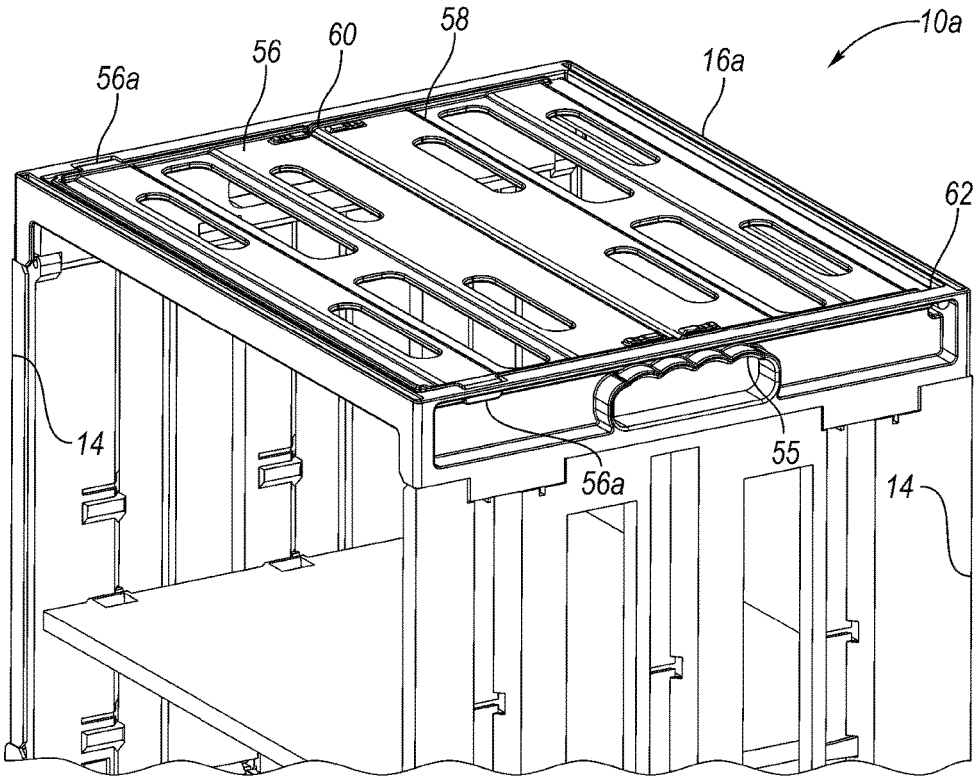
FIG. 18 is a side perspective view, partially cut away, that shows another example embodiment of a cap for a shelving unit.

As shown in FIGS. 15-17, multiple collapsed units 10 can be stacked on one another (FIG. 17) for storage or shipping when empty. The recess 17 in the top of the cap 16 (FIG. 15) receives the rail 19 (FIG. 16) on the bottom of the base 12 (FIG. 16). The rail 19 extends from a bottom surface of the base 12 at a location that is spaced just inwardly of an outer periphery of the base 12. A raised lip 17*a* extends upwardly around the recess 17 to abut against the rail 19 and prevent the upper unit 10 from sliding off of the lower unit 10 during transport.

FIGS. 18-26 show a shelving unit 10A according to another example embodiment. The shelving unit 10A is the same as the shelving unit 10 of FIGS. 1-17, except for the cap 16A. The cap 16A includes a first panel portion 56 and a second panel portion 58 connected to one another by a hinge 60. The second panel portion 58 is slidably and pivotably connected to one edge of the cap 16A by a hinge 62. The panel portions 56, 58 may include various openings to reduce weight. Handles 55 may be formed through sides of the cap 16A.

Figure 19:
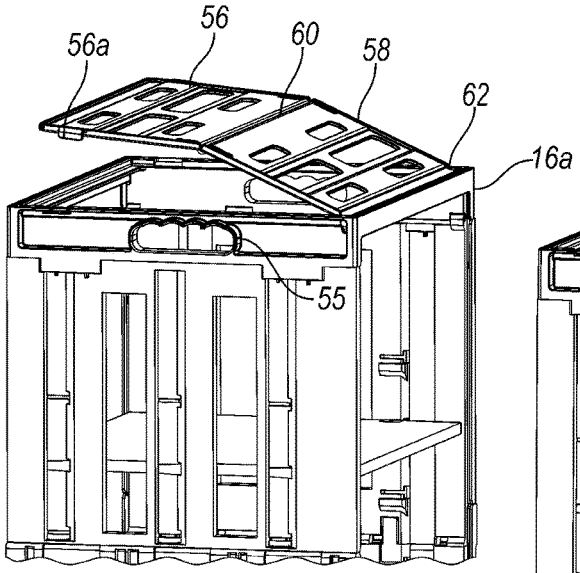
FIG. 19 is a view similar to FIG. 18 but showing the cap in a partially raised position.

When the shelving unit 10A is full of goods for sale and shipped to the store, the cap 16A may be opened as shown in FIGS. 19-23. The first panel portion 56 includes side lock tabs 56*a* (FIG. 18) that lock the first panel portion 56 to the cap 16A. Referring to FIG. 19, the lock tabs 56*a* are unlocked from side edges of the cap 16A, and the first panel portion 56 and hinge 60 are lifted, causing the second panel portion 58 to pivot about the hinge 62.

Figure 20:
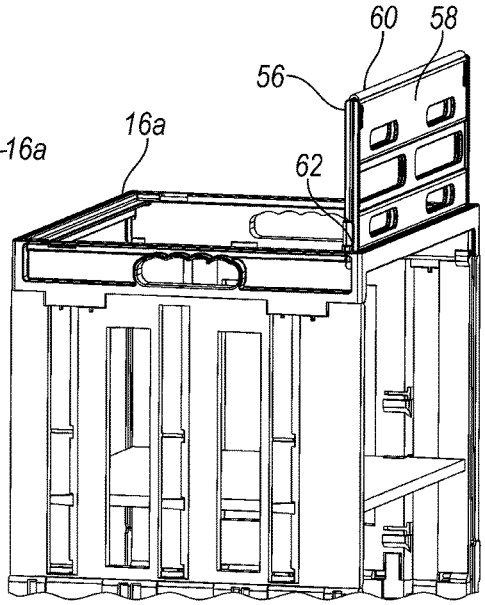
FIG. 20 shows the cap in a fully raised position.
Figure 21:
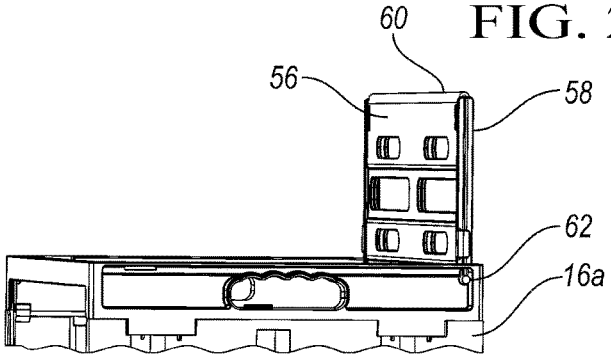
FIG. 21 is a front view of FIG. 20.

The first panel portion 56 is brought toward the second panel portion 58 until they are both substantially vertical, as shown in FIGS. 20 and 21. When in the vertical position, the first 56 and second 58 panel portions are overlapping and abut against each other.

Figure 22:
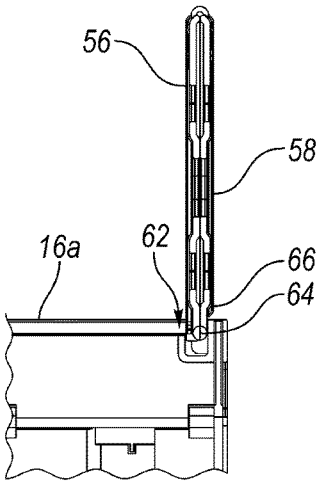
FIG. 22 is a side view of FIG. 20 with the cap in an initial position.
Figure 23:
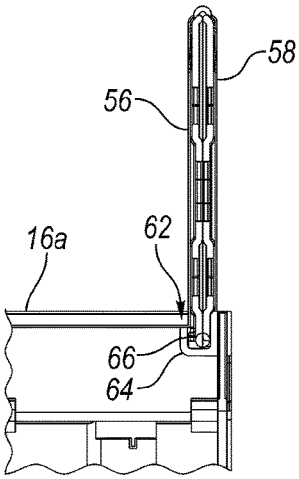
FIG. 23 shows the cap in a final display position.

As shown in FIGS. 22 and 23, the hinge 62 includes a hinge pin 66 that allows the second panel 58 to pivot relative to the cap 16A. Once in the vertical position, the panel portions 56, 58 and hinge pin 66 are slid down vertically into a recess 64 formed in an upper surface of an edge of the cap 16A. This securely retains the panel portions 56, 58 in a substantially vertical position.

Figure 24:
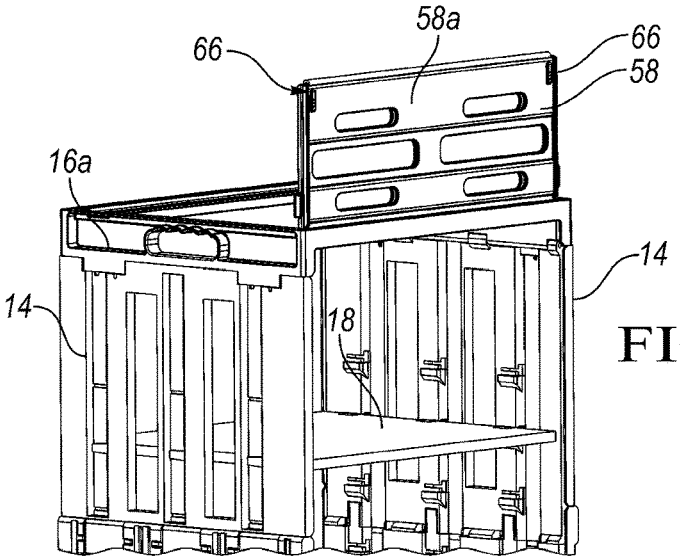
FIG. 24 is a rear perspective view of the cap showing tab holders.
Figure 25:
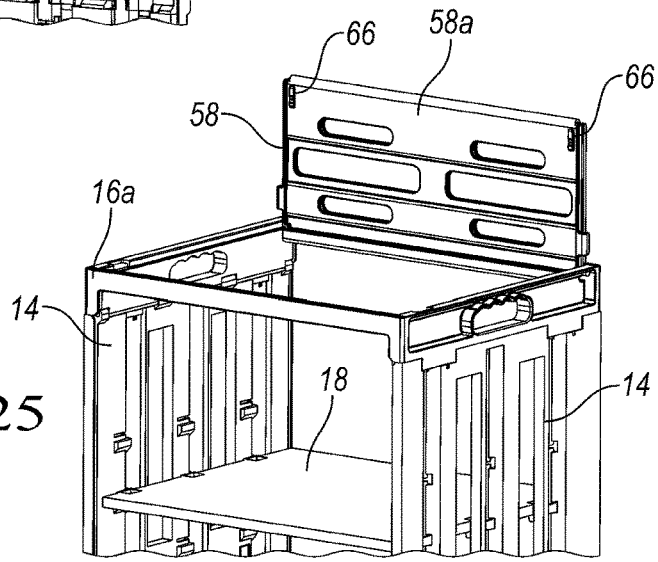
FIG. 25 is a front view of FIG. 24.
Figure 26:
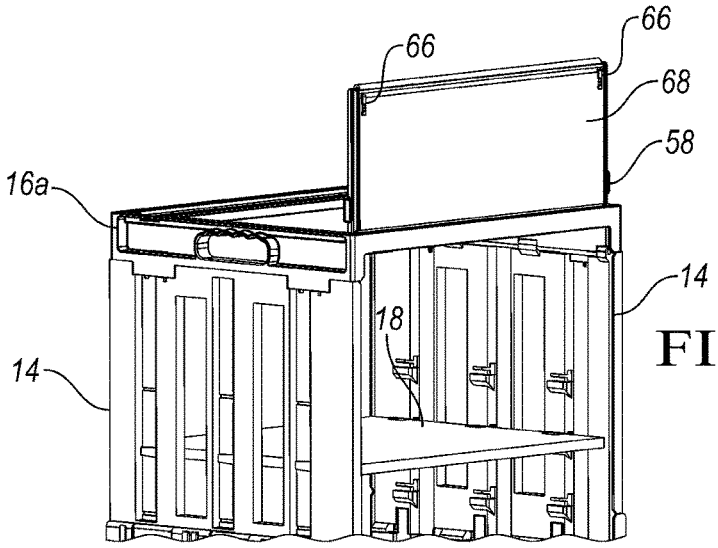
FIG. 26 is similar to FIG. 24 but shows a display attached to the holders.

As shown in FIGS. 24-26, tabs 66 on a forward facing surface 58*a* of the second panel portion 58 can be used to hold a temporary sign 68 (FIG. 26). The sign 68 can be made from any of various materials (cardboard, paper, or the like) and can promote or describe the goods for sale on the shelves 18.

FIGS. 27-37 show a shelving unit 110 according to a third embodiment. The shelving unit 110 is the same as those described in the first and second embodiments except as otherwise described or shown in the drawings.

Figure 27:
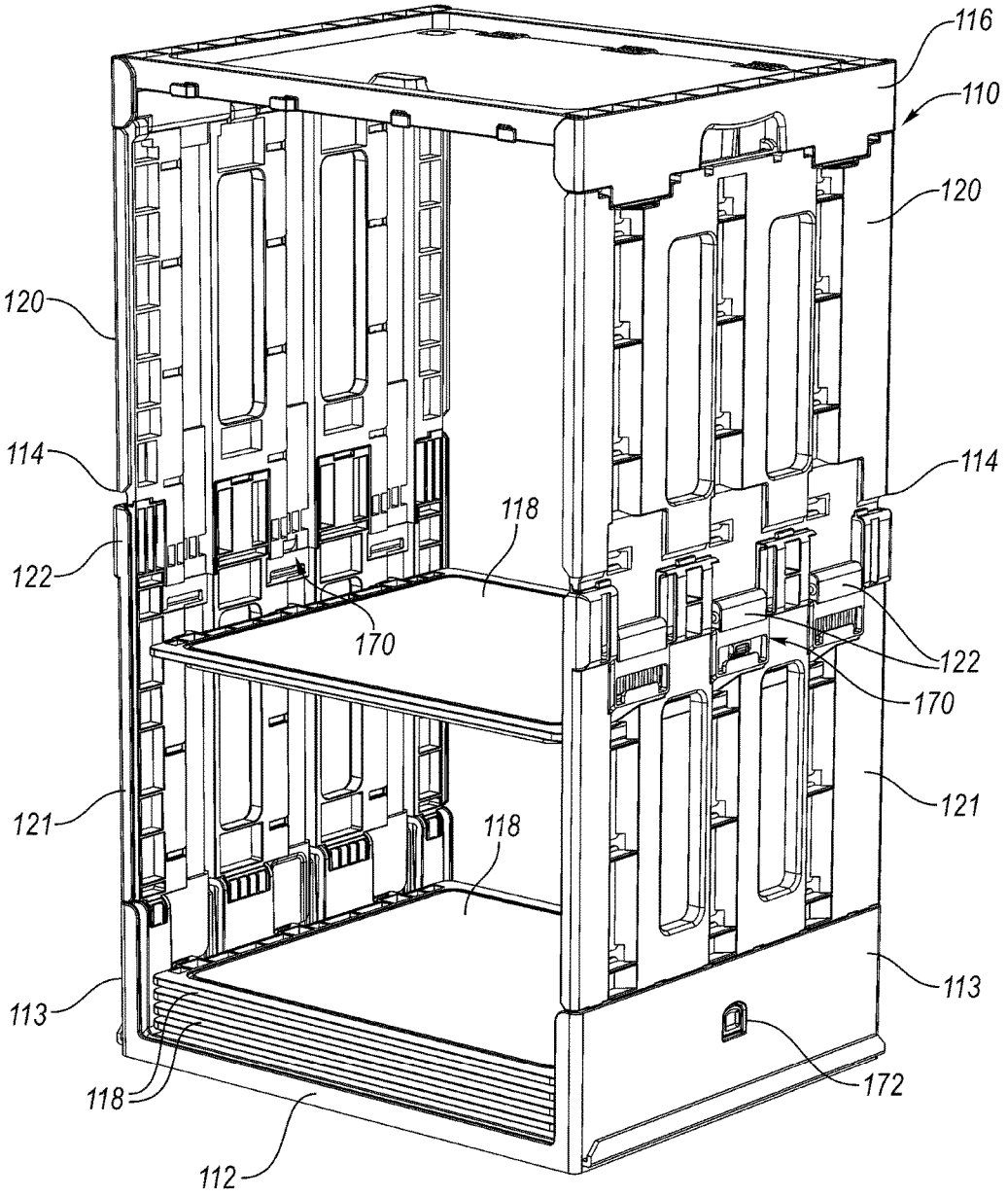
FIG. 27 is a front perspective view of another example of a collapsible shelving unit.

Referring to FIG. 27, the unit 110 includes a base 112 having integral upstanding side portions 113 and a pair of side walls 114 extending upward from the side portions 113. A cap 116 is secured to upper edges of the side walls 114. A plurality of shelves 118 are mounted to the side walls 114 and vertically spaced from one another. Each side wall 114 includes a plurality of side panels 120, 121 connected by hinges 122.

Figure 28:
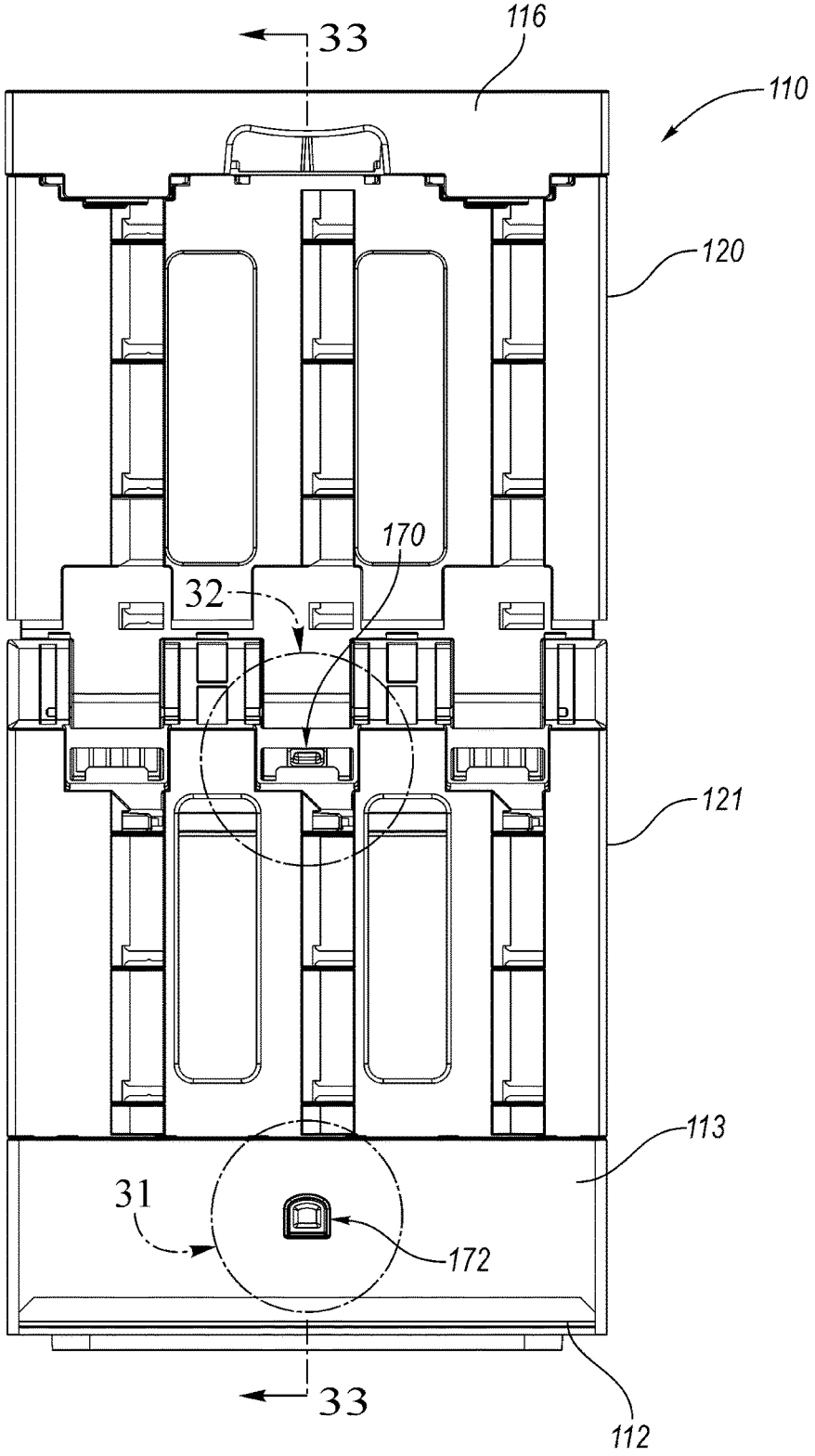
FIG. 28 is a side view of the unit of FIG. 27.

In this embodiment, a latch 170 connects each of the upper side panels 120 to one of the lower side panels 121. A latch 172 also connects each of the lower side panels 121 to one of the upstanding side portions 113. FIG. 28 is a side view of the shelving unit 110 showing the latches 170, 172.

Figure 29:
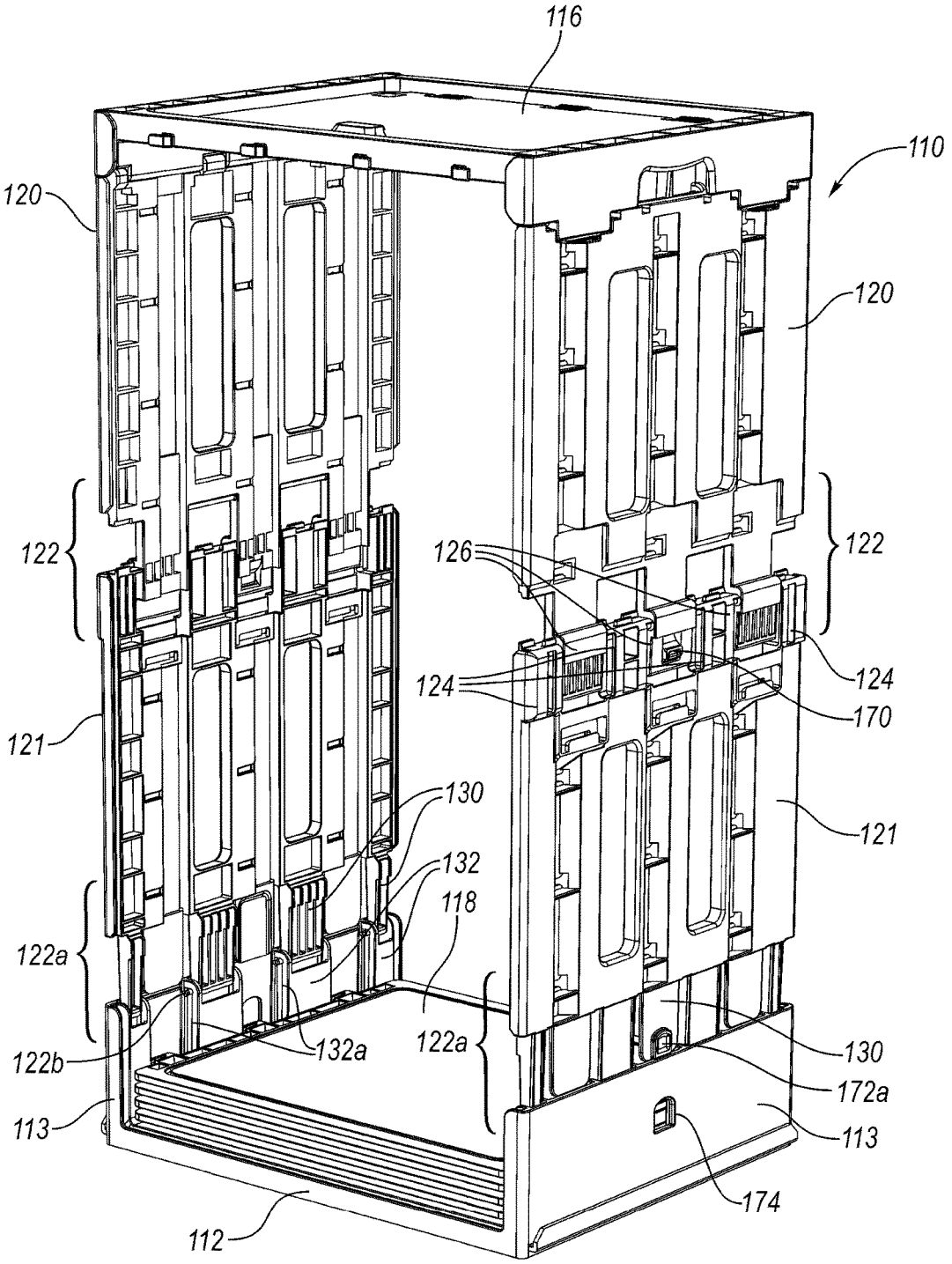
FIG. 29 is a view similar to 27 but showing the side panels in an unlatched position.
Figure 30:
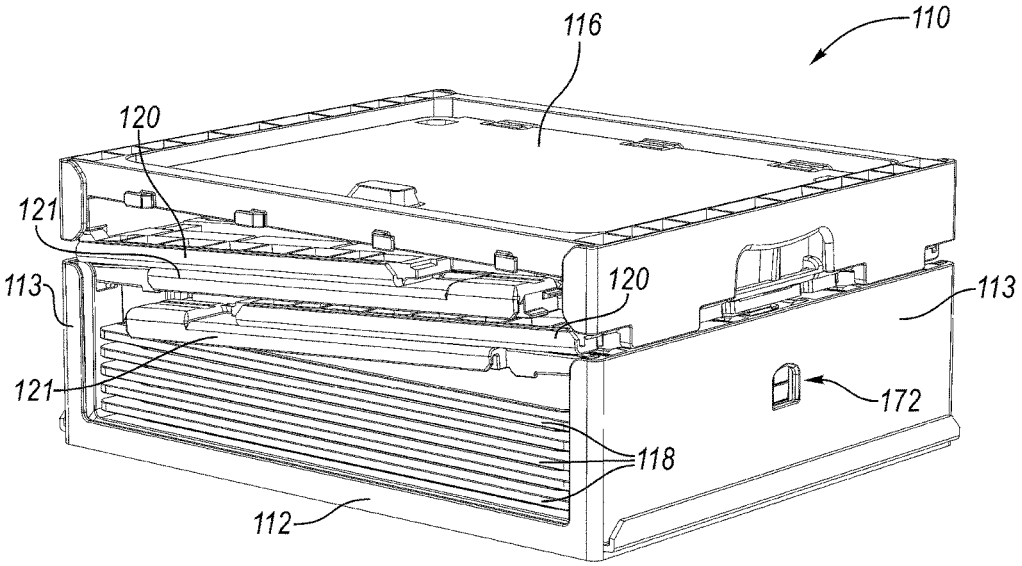
FIG. 30 shows the unit in collapsed position.

FIG. 29 shows the upper panels 120 slid upward on slidable hinges 122 relative to lower panels 121 and lower panels 121 slid upward on slidable hinges 122*a* relative to the upstanding side portions 113. The hinges 122*a* include pins 122*b* in lower leg portions 130 of the lower panels 121. The leg portions 130 are received in corresponding receptacles 132 of the side portions 113. The receptacles 132 include slots 132*a* that slidably receive the pins 122*b* to allow the lower panels 121 to be slide upwardly. The latches 170, 172 have been disengaged to permit the upward displacement. From the position of FIG. 29, the panels 120, 121 can be folded inward onto the base 112 and between the side portions 113 as shown in FIG. 30 for efficient storage and shipping.

Figure 31:
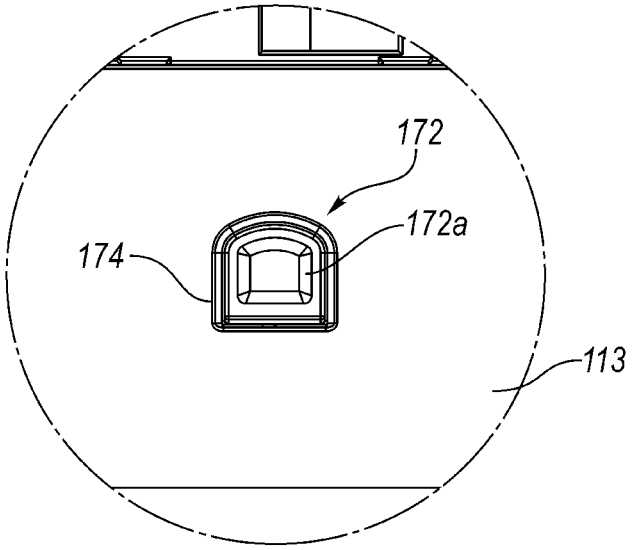
FIG. 31 is a magnified view of a latch between the base and a side panel.

FIG. 31 is an enlarged view of the area around the latch 172 in the base 112. The latch 172 comprises a resilient protruding body 172*a* (FIG. 29) that is formed in an outwardly facing surface of one or more of the leg portions 130 of the lower panel 121. The body 172*a* is received in an opening 174 in the side upstanding portion 113 of the base 112. The body of the latch 172 is pushed inwardly relative to the opening 174 to release the leg portion 130 from the side portion 113 and allow the side panel to be raised relative to the base 112. Once in the raised position, the side panel 121 can be pivoted into the collapsed position.

Figure 32:
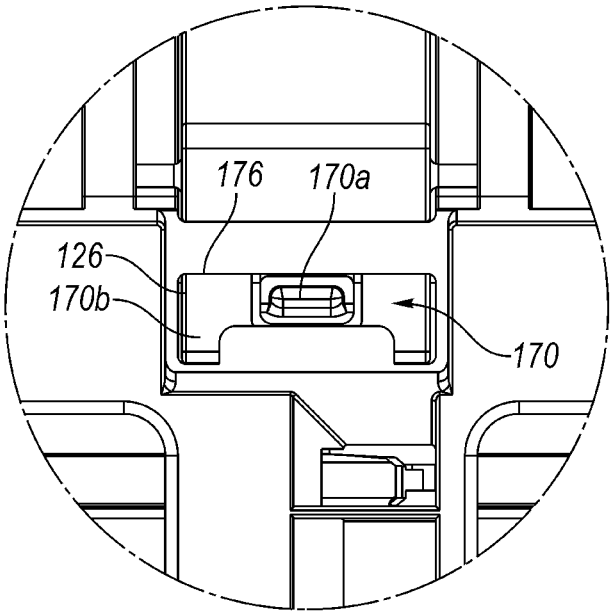
FIG. 32 is a magnified view of a latch between two adjacent side panels.
Figure 33:
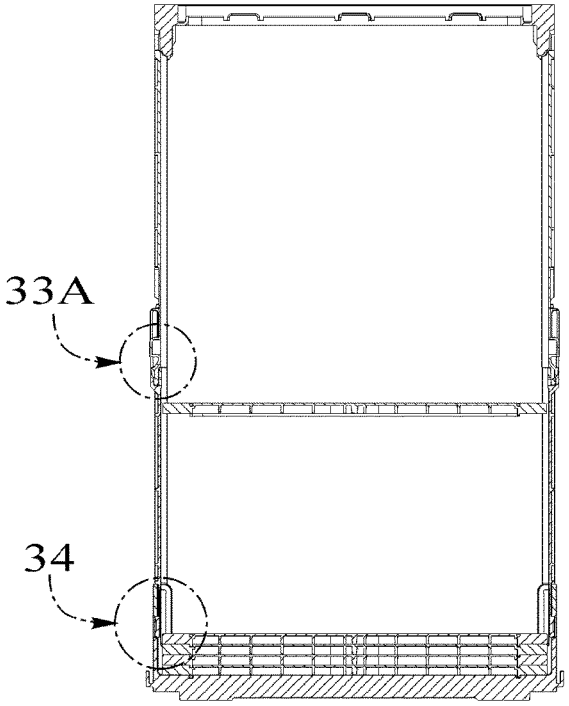
FIG. 33 is a front section view of the unit with latches.
Figure 33A:
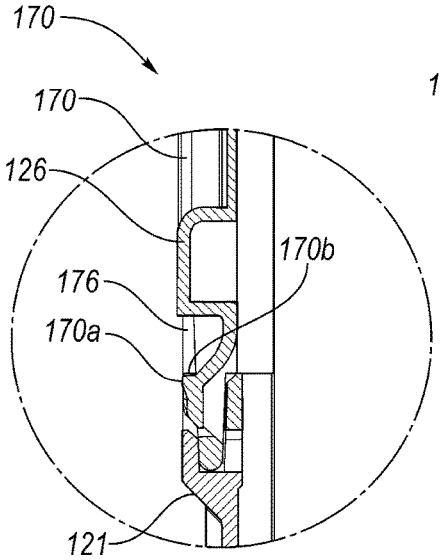
FIG. 33A is a section view of the latch as indicated in FIG. 33.

FIG. 32 is an enlarged view of the area around the latch 170. The latch 170 includes a body 170*a* associated with the upper panel 120 that is received within an opening 170*b* formed in a portion of the lower panel 121. As more clearly shown in FIG. 33, the latch body 170*a* snaps past a shoulder 176 and is received in the opening 170*b*. To release, the latch 170 is pressed inward so that the body 170*a* can slide upward relative to the shoulder 176.

Figure 34:
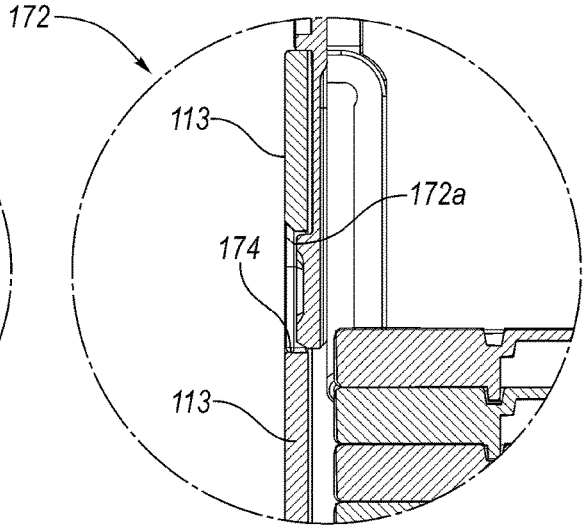
FIG. 34 is a section view of the latch as indicated in FIG. 33.

FIG. 34 is a section view through the latch 172 in the base 112. As shown, the latch body 172*a* snap-fits into the opening 174 in the upstanding side portion 113. To release, the latch 172 is pressed inward out of opening 174 so that it can slide upward.

Figure 35:
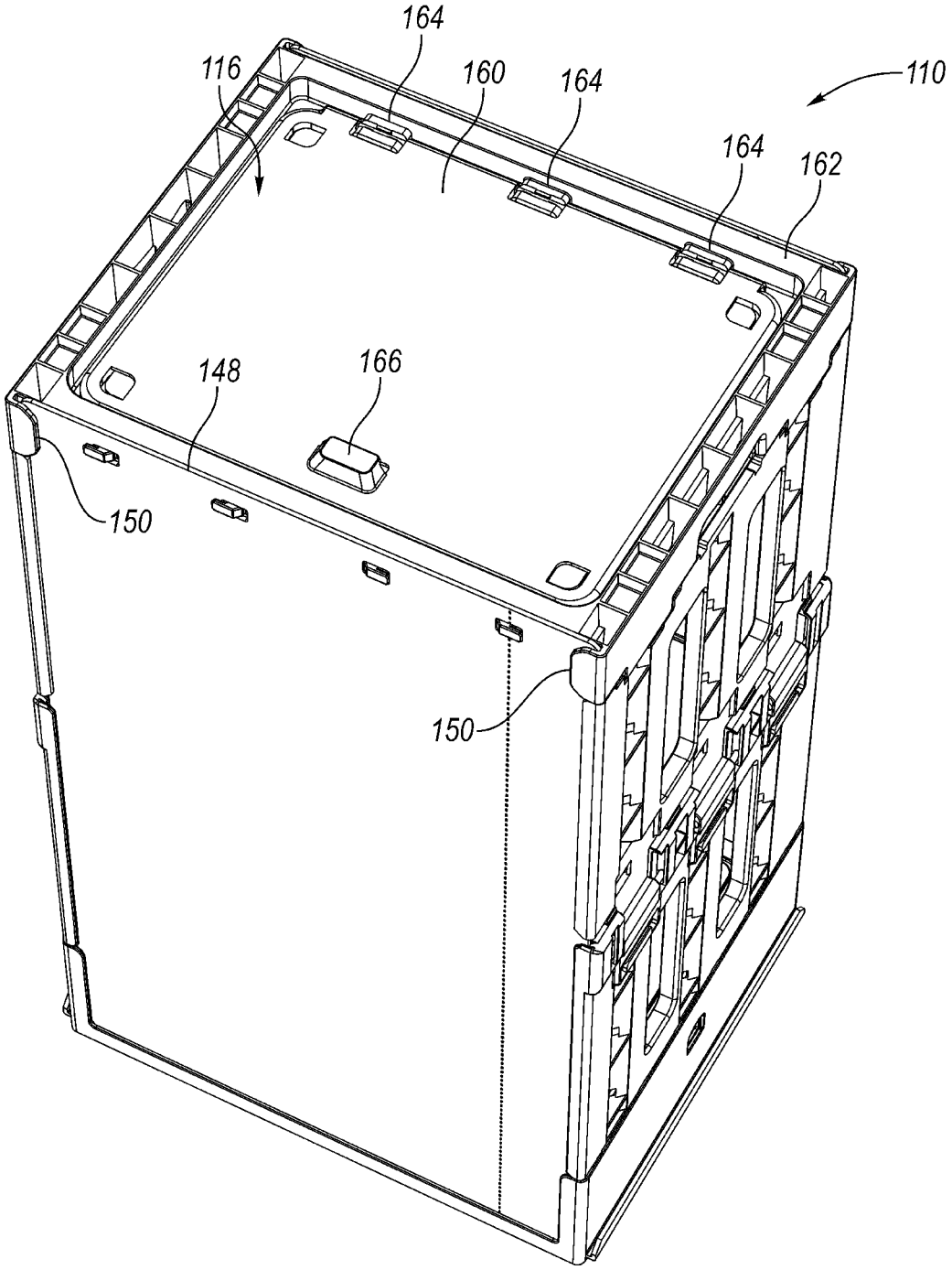
FIG. 35 is a top perspective view that shows another example embodiment of a cap for a shelving unit.
Figure 36:
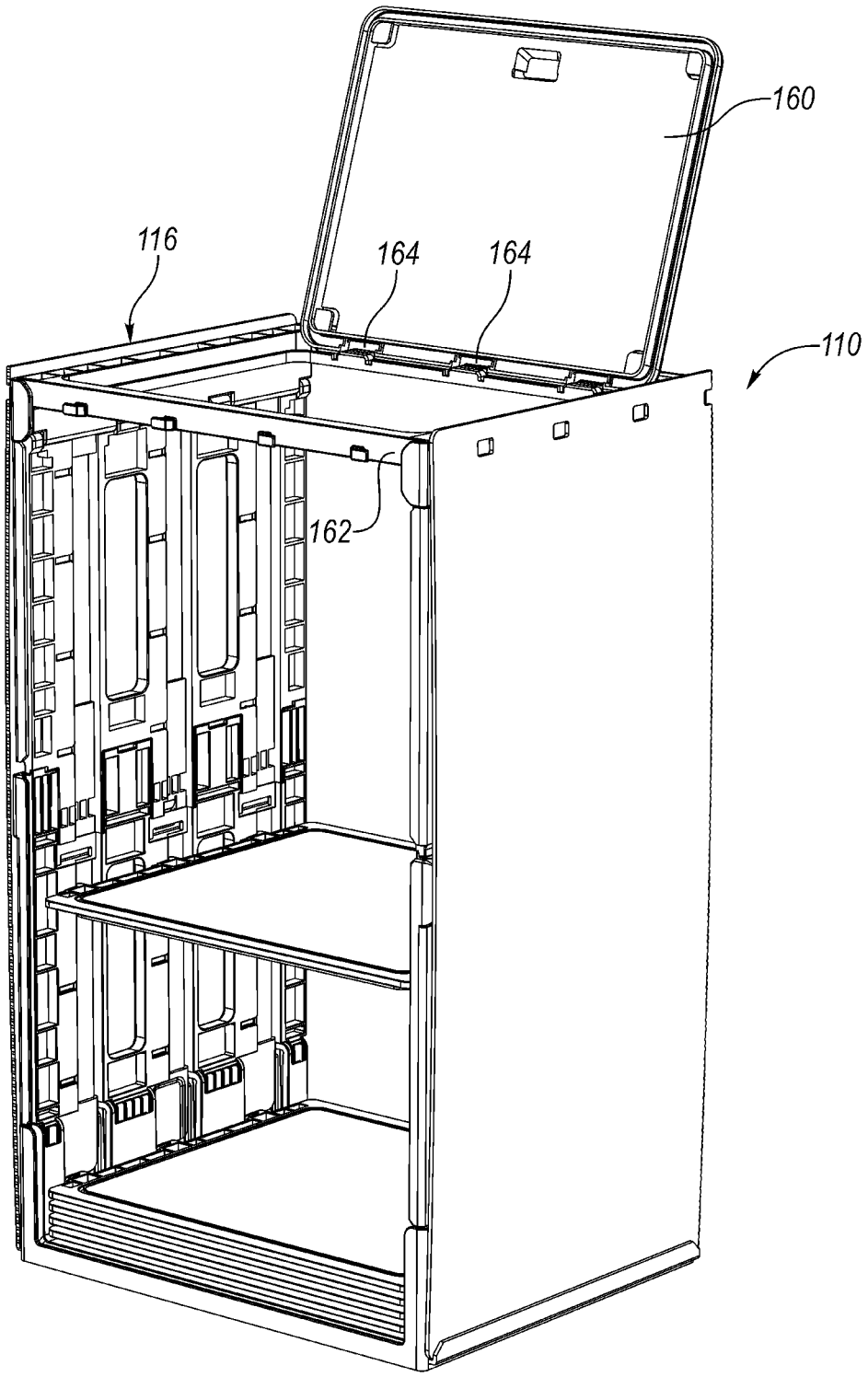
FIG. 36 is a front perspective view of the unit of FIG. 35 but showing the cap in an open position.
Figure 37:
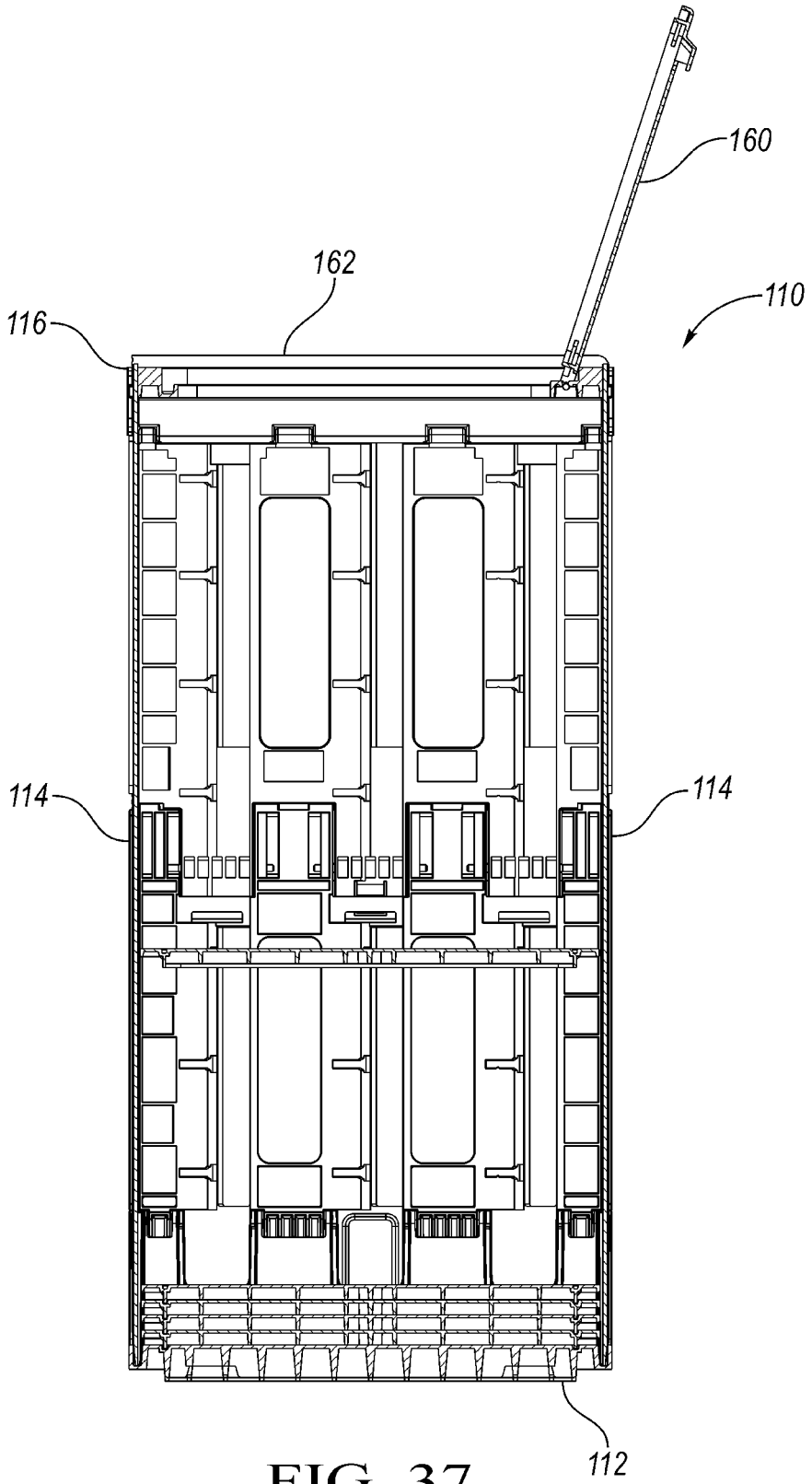
FIG. 37 is a section side view of the unit of FIG. 36.

As shown in FIGS. 35-37, a lid 160 can be secured to an upper frame 162 to form the cap 116. The lid 160 is connected to the frame 162 by hinges 164. The lid 160 can be opened via a handle 166 to provide access to products in the shelving unit 110 (FIG. 36). Also shown in FIG. 35 is the front panel 148 secured between the hooks or tabs 150, which helps retain the product on the shelving unit 110 during transport.

Another example of a shelving unit 310 is shown in FIGS. 38-46. In this example, the collapsible shelving unit 310 includes a base 312 and a pair of side walls 314 extending upward from side edges of the base 312. A cap 316 having a handle 316*a* is secured to upper edges 314*a* of the side walls 314. A plurality of shelves 318 are mounted to the side walls 314 and are vertically spaced from one another. Each side wall 314 includes a plurality of side panels 320 connected by hinges 322.

Figure 39:
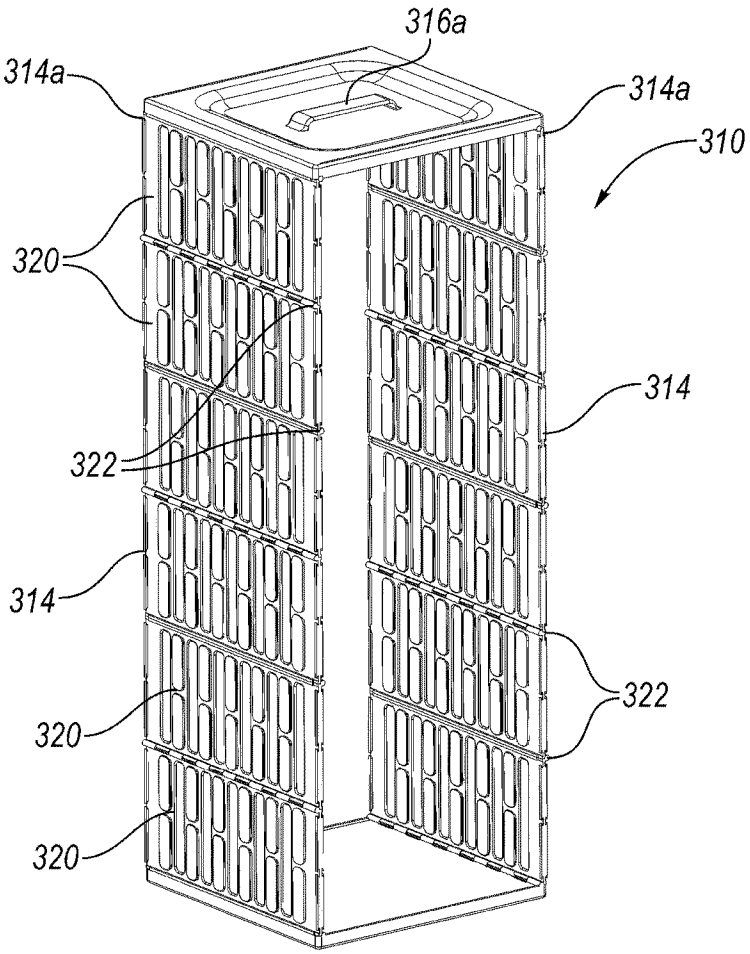
FIG. 39 is a view similar to FIG. 38 but with the shelves removed.
Figure 38:
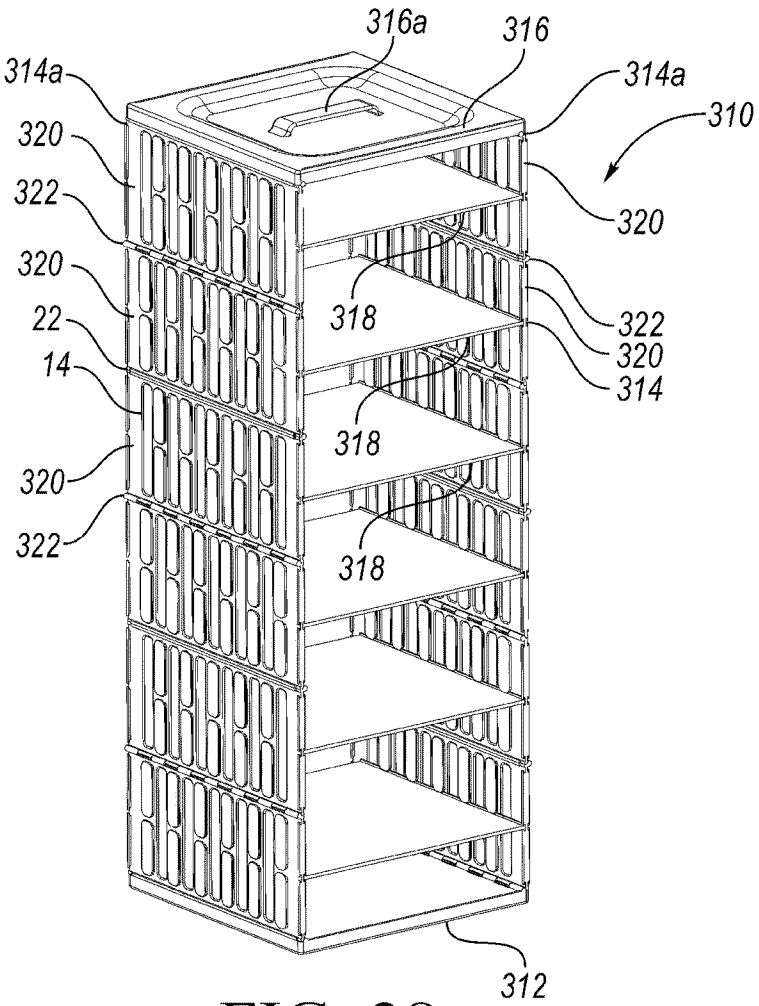
FIG. 38 is a front perspective view of another example of a collapsible shelving unit with shelves installed.
Figures 40A, 40B, 40C, 40D:
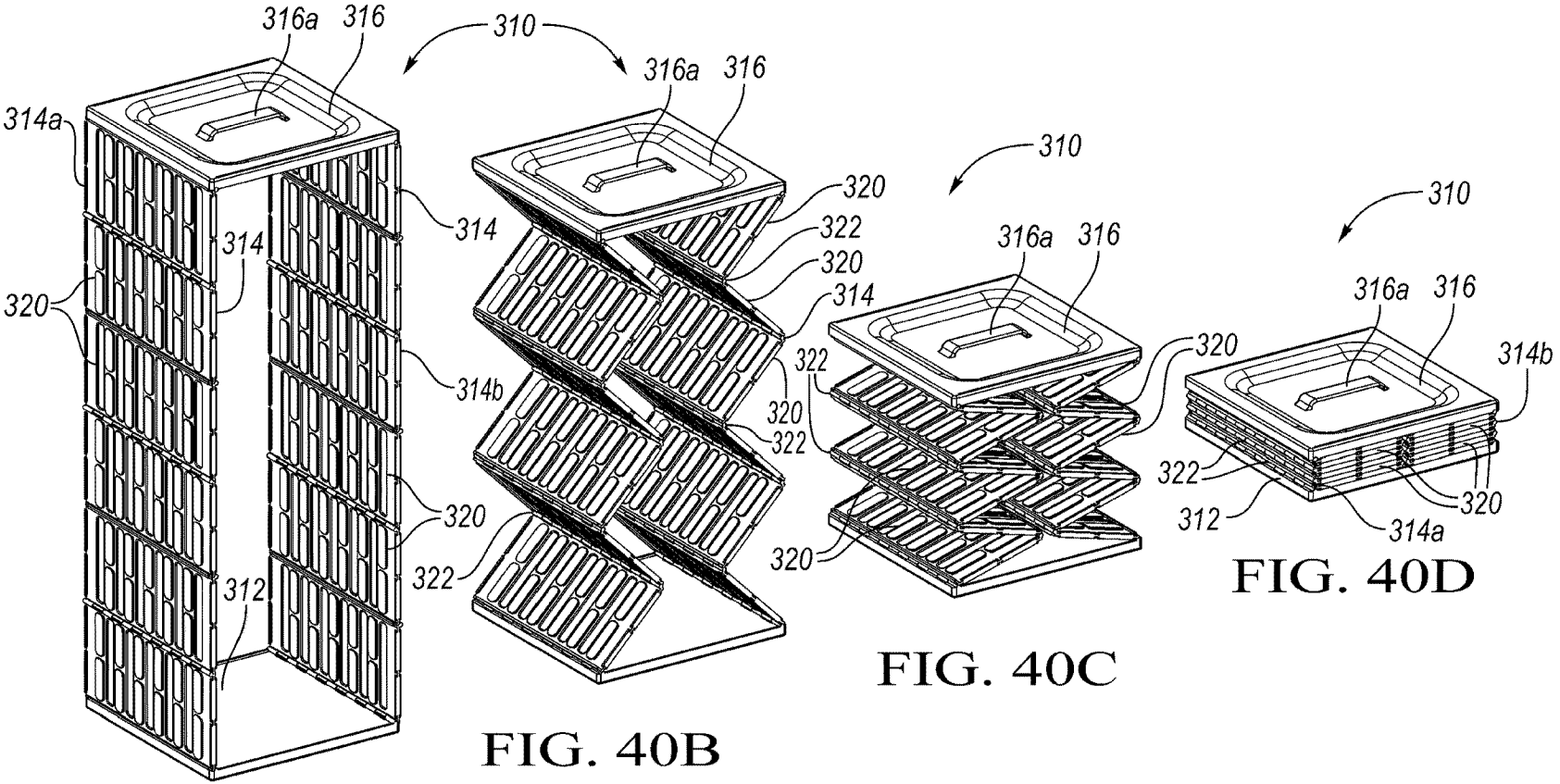
FIGS. 40A-40D show a progression of moving the unit of FIG. 39 to a collapsed position.

FIG. 39 shows the unit 310 with the shelves 318 removed. As shown in the sequence of FIGS. 40A-D, with the shelves 318 removed, the hinges 322 can pivot in alternating directions as shown in FIG. 40B. Optionally, the hinges 322 only pivot in the directions shown.

With the shelves 318 removed, the shelving unit 310 can be folded down to a very compact assembly as shown in FIG. 40D. In this configuration, the panels 320 that form one side wall 314*a* overlap each other and the panels 320 that form the opposite side wall 314*b* overlap each other. However, panels 320 from side wall 314*a* do not overlap panels 320 from side wall 314*b*.

Figures 41A, 41B, 41C, 41D, 41E:
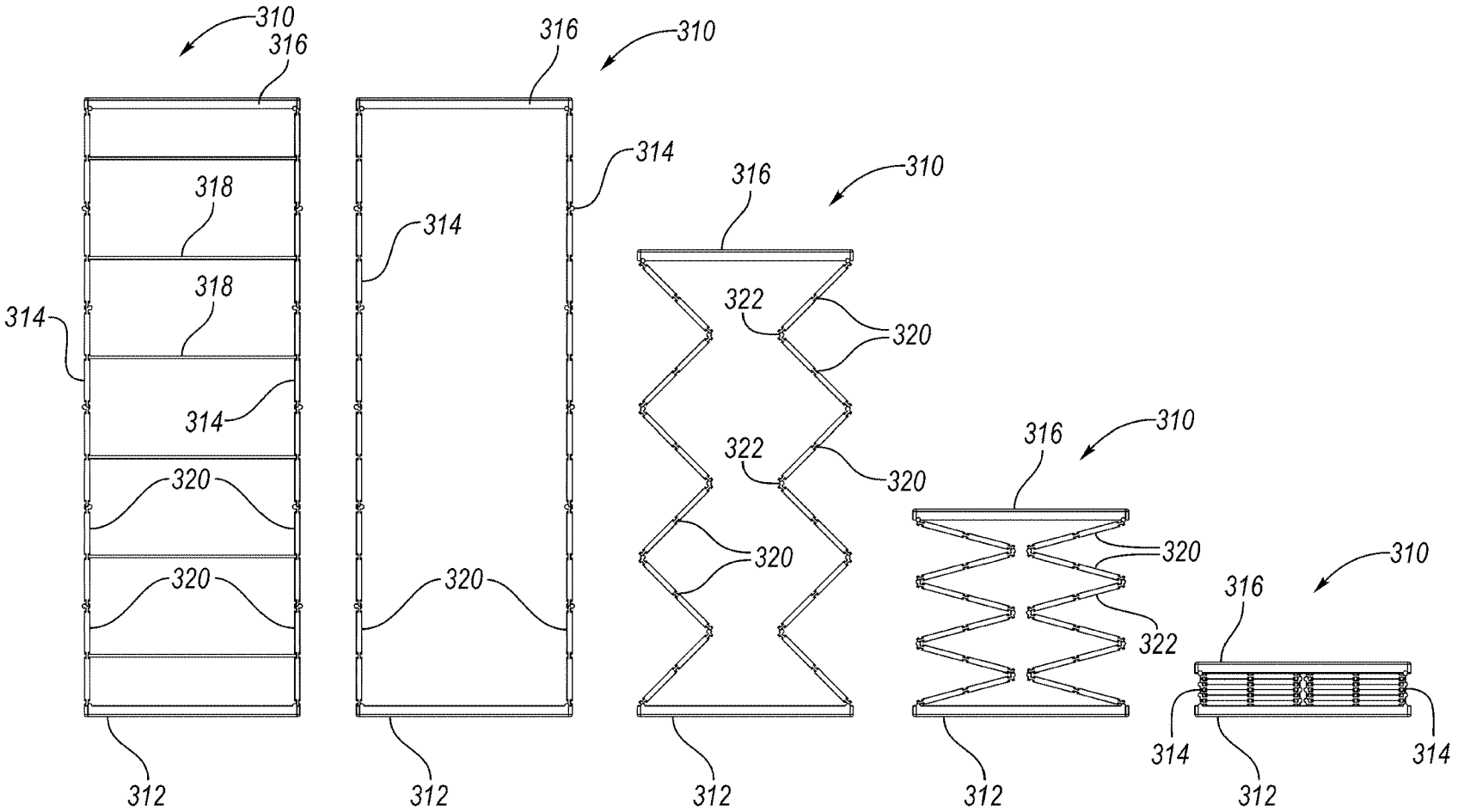
FIG. 41A is a front view of shelves installed.
FIGS. 41B-41E are corresponding front views of FIGS. 40A-40D.

FIGS. 41A-E show front views of the shelving unit 310 in the assembled position (FIG. 41A), with shelves 318 removed (FIG. 41B) and being collapsed (FIGS. 41*c*-4D). FIG. 41E shows the unit 310 fully collapsed.

Figure 42:
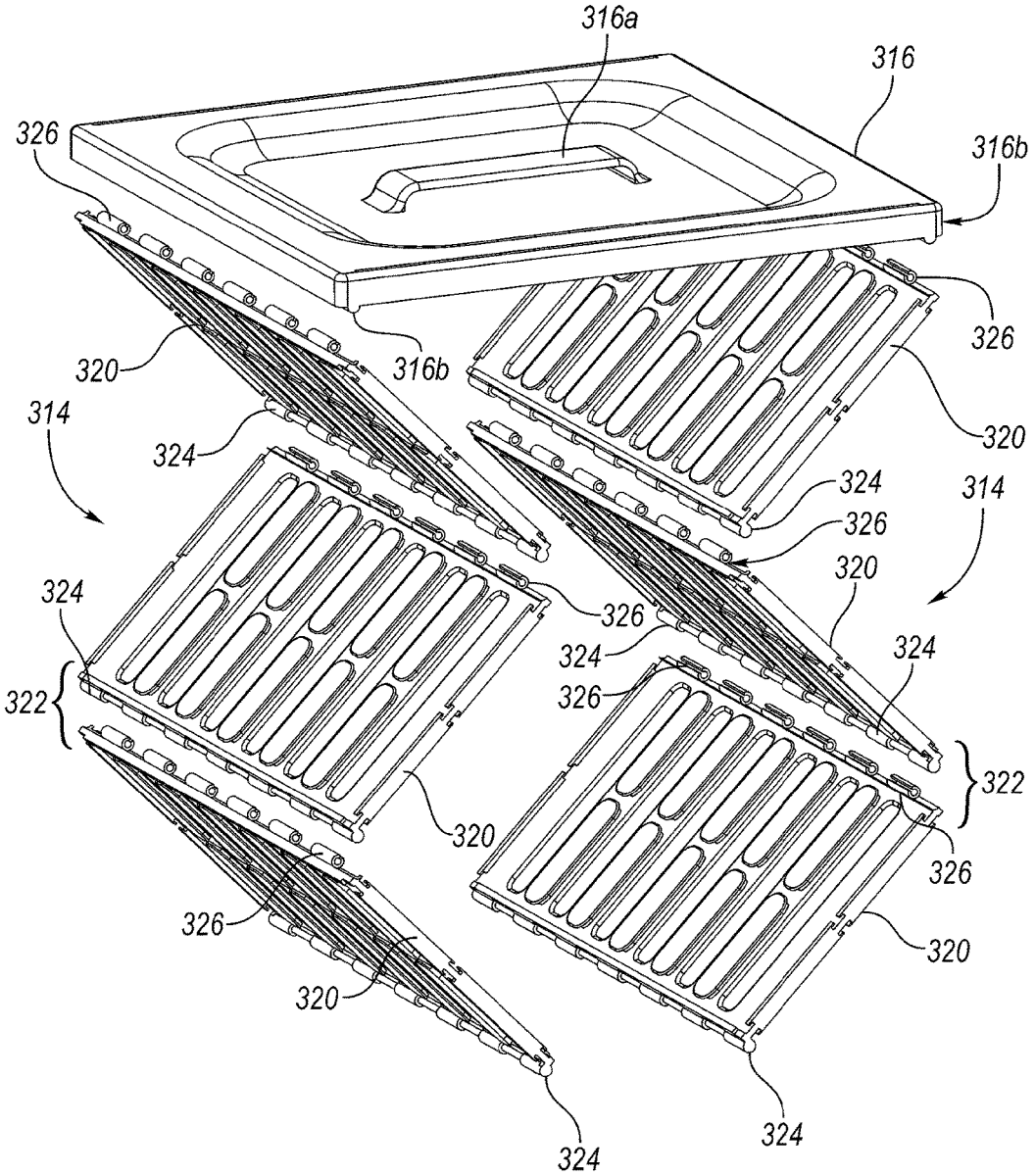
FIG. 42 is a partial exploded view of side panels and cap.

FIG. 42 is a partial exploded view of the side walls 314 and cap 316. Each of the panel 320 includes a lower hinge portion 324 and a complementary upper hinge portion 326. The lower hinge portion 324 and the upper hinge portion 326 hingeably connect to form hinge 322. Further, the cap 316 includes a hinge portion 316*b* that cooperates with the upper hinge portion 326 of the uppermost panel 320 to facilitate raising and lowering of the side walls 314. Again, the hinges 322 may also be formed such that they pivot only in the alternating directions as shown in FIG. 42.

Figure 43:
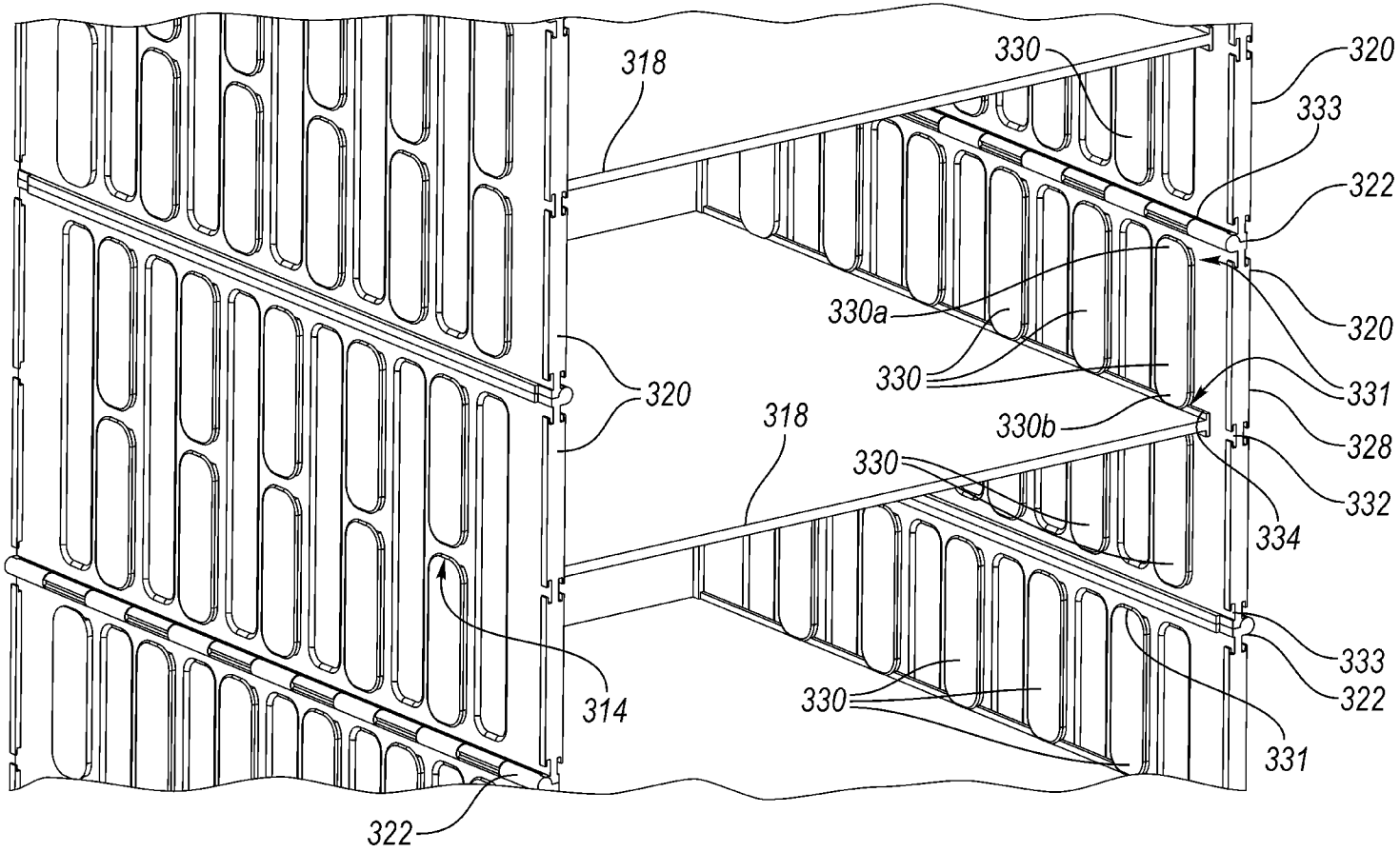
FIG. 43 is a magnified view of a connection interface between the side panels and a shelf.

FIG. 43 is an enlarged view of the shelves 318 showing how they connect to the side walls 314. Each of the side panels 320 includes an outer flange 328 having a center notch 332 and upper and lower notches 333 formed therein. The upper and lower notches 333 are adjacent the hinges 322. The panels 320 each include a plurality of elongated disks 330 that extend in a vertical direction. Each disk 330 partially defining a channel 331 between the disk 330 and the panel 320 at an upper end 330*a* and at a lower end 330*b* of the disk 330. Each side edge of the shelves 318 includes a flange 334 that slidably interlocks in the channels 331 and notches 332. The flange 334 includes an upwardly extending portion that is received within the channel 331 at the lower end 330*b* of a first disk 330 and a downwardly extending portion that is received within the channel 331 at the upper end 330*a* of another disk 330 located vertically below the first disk 330.

Figure 45:
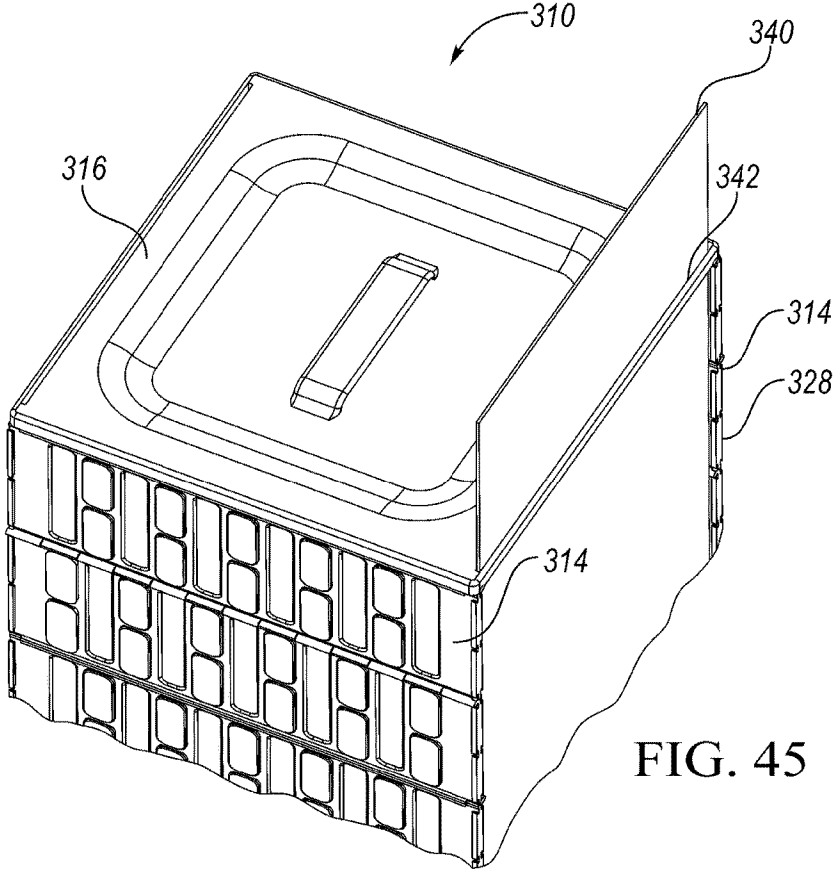
FIG. 45 is a magnified view of an interface between the front panel and the cap.
Figure 44:
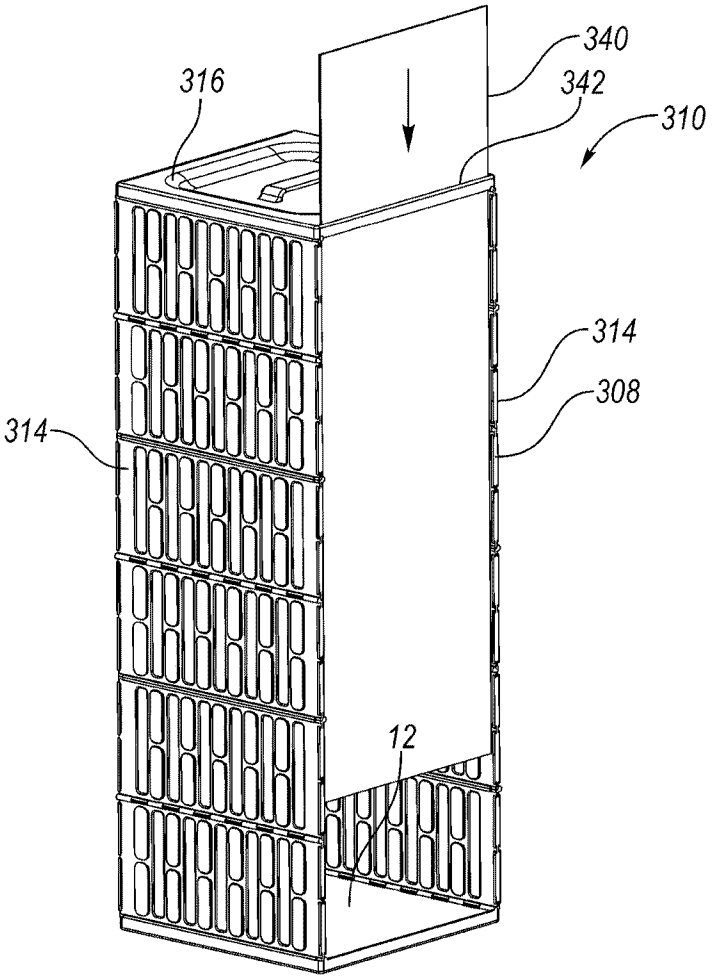
FIG. 44 is a front perspective view showing a front panel partially installed.
Figure 46:
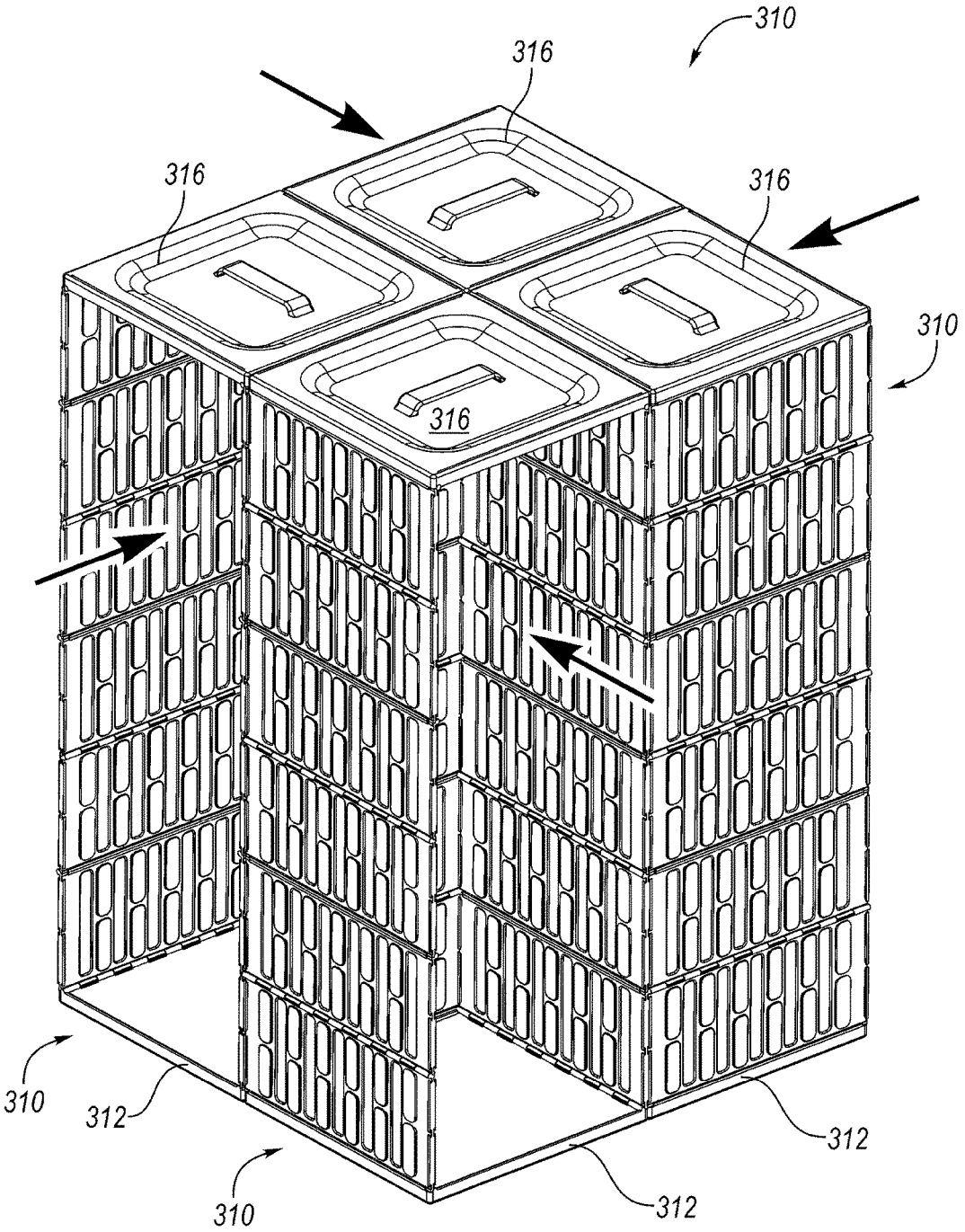
FIG. 46 is a perspective of multiple units arranged for transport on a single pallet.

As shown in FIGS. 44 and 45, a back panel 340 can optionally be slid through a slot 342 in the cap 316 and down through channels defined between the flanges 328 at the outer ends of the side walls 314 and the shelves 318. Alternatively, front and rear panels 340 can be inserted during shipping and one of the panels can be removed in the store. As shown in FIG. 46, four of the shelving units 310 can be stacked on one pallet (not shown), with each unit 310 arranged so that an open rear of the unit 310 is against a side wall 314 of another unit 310 to help keep items in the unit 310.

In use, goods for sale are placed on the shelves 318 on several shelving units 310, which are then placed on the pallet. The pallet and shelving units 310 are then delivered to a store and placed on the floor. Customers can view and select the goods directly from the shelves 318. When empty, the shelves 318 are removed and the side walls 314 are collapsed onto the base 312. The collapsed shelving units 310 are then returned to the distribution facility for reuse.

FIGS. 47-50 show a shelving unit 410 according to another embodiment. The shelving unit 410 includes a base 412 having upstanding peripheral walls 413. A pair of posts or poles 414 extend upward from the base 412. A plurality of shelves 418 are mounted to both poles 414 at different heights. Collars 420 are secured to the shelves 418 and are removably secured to the poles 414 at the selected heights.

When empty, the shelves 418 can be slid down into the base 412 on poles 414 by releasing the collars 420, as shown in FIG. 48. The poles 414 can be retracted (e.g. like a telescope) to the position shown in FIG. 49. The poles 414 can be removed from the base 412 and then placed inside the base 412 with the shelves 418 as shown in FIG. 50. The shelves 418 may be formed of a transparent, clear plastic for increased visibility as shown.

FIGS. 51 and 52 show an alternate shelving unit 510 formed on a pallet 512. The shelving unit 510 includes a plurality of flat, clear plastic shelves 518 mounted on the poles 514. The shelves 518 are mounted to collars 520 which can slide on the tube portion of the poles 514. The collar 520 is connected to the tube portion above, such that the collar 520 and the above tube portion both telescope onto the tube portion below and the shelf 518 moves with the collar 520. A latch 521 can be used to hold the collar 520 fixed relative to the poles 514.

Figure 54:
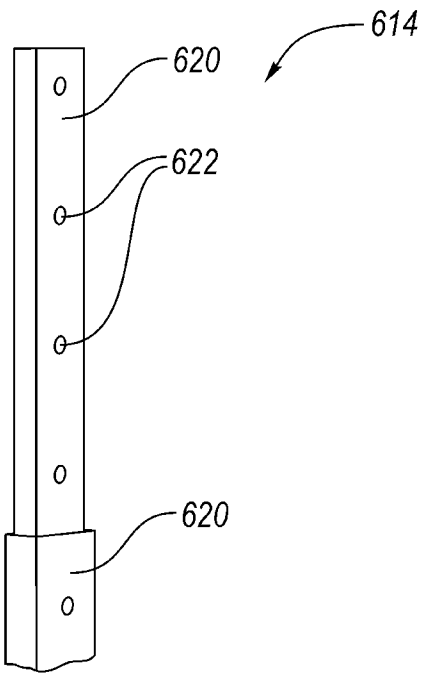
FIG. 54 is a magnified view of one of the posts of FIG. 53.
Figure 53:
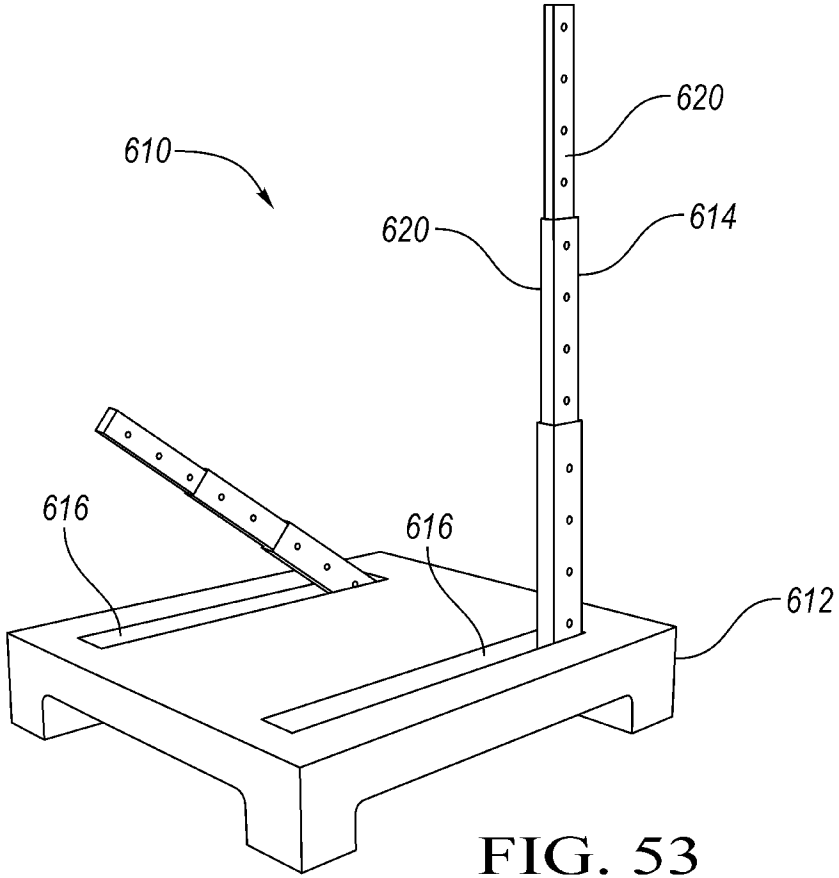
FIG. 53 is a perspective view of another example of a collapsible shelving unit.

FIGS. 53 and 54 show an alternate shelving unit 610 to which shelves can be removable mounted. The unit 610 includes a pallet base 612 and a pair of poles 614 pivotably mounted within elongated recesses 616 formed in the pallet base 612. The poles 614 each include a plurality of telescoping sections 620. The poles 614 can be extended to an upright, use position (as shown on the right of FIG. 53) or retracted and then pivoted downward into the recess 616 of the pallet base 612. As shown in FIG. 54, the pole 614 includes a plurality of apertures 622 for mounting shelves thereto.

Figure 56:
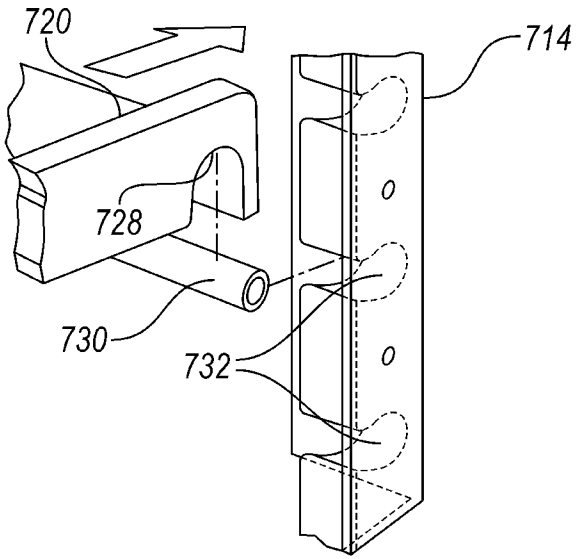
FIG. 56 is a magnified view of a shelf and post attachment interface for the embodiment of FIG. 55.
Figure 55:
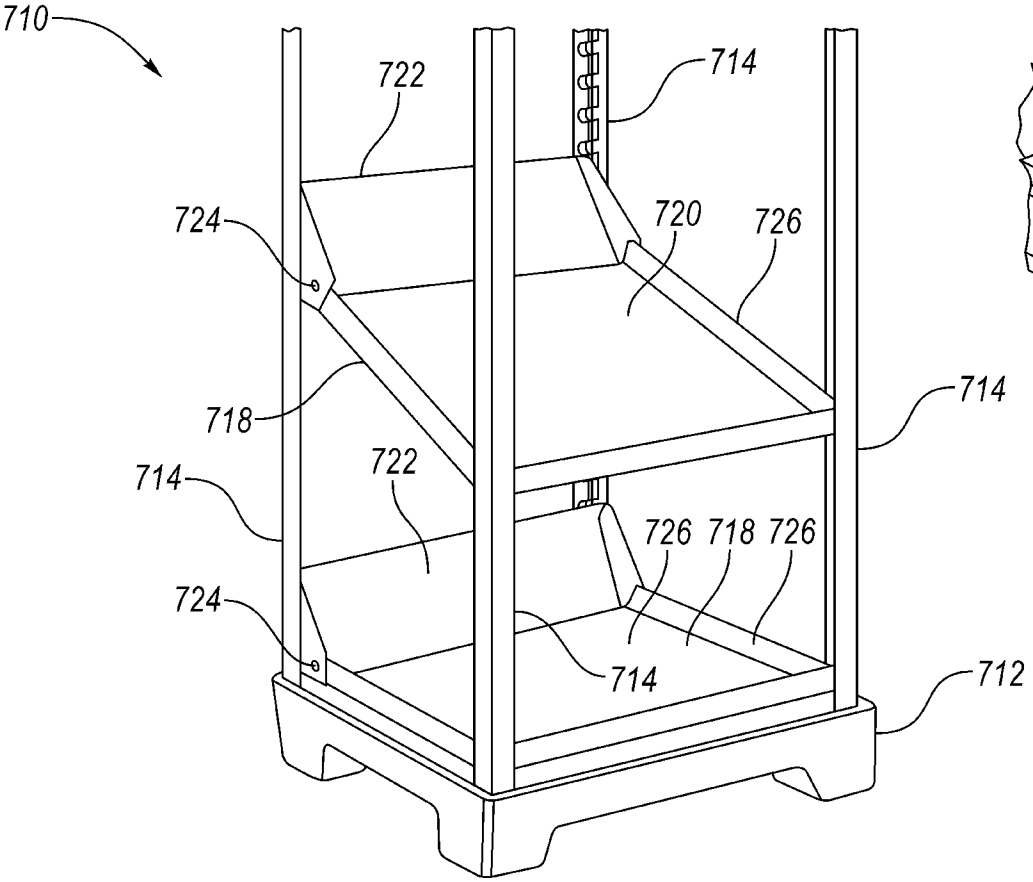
FIG. 55 is a perspective view of another example of a collapsible shelving unit.

FIGS. 55 and 56 show a shelving unit 710 according to another embodiment. The shelving unit 710 includes a pallet base 712 and vertical supports 714 extending upward from the corners of the pallet base 712. A plurality of shelves 718 are mounted to the vertical supports 714. The shelves 718 each include a front portion 720 and a smaller rear portion 722 connected by a hinge 724. A lip 726 projects upward from the periphery of the shelf 718.

As shown in FIG. 56, each of the front and back edge of the shelf 718 includes at least one recess 728 on an underside of the shelf 718 for receiving a tube 730. Each vertical support 714 includes a plurality of recesses 732 for receiving the tube 730 to support the tube 730 and shelf 718 at a selected height. To disassemble the shelving unit 710, the shelves 718 are removed from the tubes 730, the tubes 730 are removed from the vertical supports 714, and the supports 714 are removed from the pallet base 712.

The height of the shelves 718 is selectable, as is the angle at which the shelf 718 sits on the shelving unit, by selecting the heights of the front and rear tubes 730.

As before, goods can be shipped to a store on the shelving unit 710. Customers view and select goods from the shelves in the store. The empty shelving unit 710 is disassembled and returned for reuse.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A collapsible shelving unit comprising:

a support base;

a first side wall extending upwardly from one side of said base;

a second side wall extending upwardly from an opposite side of said base, wherein each of said first and second side walls are comprised of a plurality of rigid panels connected to each other with at least one hinge such that the rigid panels are moveable between a display position where the panels extend vertically to form the first and second side walls and a stowed position wherein at least two of the rigid panels at least partially overlap each other, and wherein the at least one hinge comprises at least one slidable hinge; and a plurality of shelves supported by the first and second side walls such that the shelves can be selectively removed therefrom.

2. The collapsible shelving unit of claim 1 including a cap that is supported by upper ends of the first and second side walls.

3. A collapsible shelving unit comprising:

a support base;

a first side wall extending upwardly from one side of said base;

a second side wall extending upwardly from an opposite side of said base, wherein each of said first and second side walls are comprised of a plurality of rigid panels connected to each other with at least one hinge such that the rigid panels are moveable between a display position where the panels extend vertically to form the first and second side walls and a stowed position wherein at least two of the rigid panels at least partially overlap each other;

a plurality of shelves supported by the first and second side walls such that the shelves can be selectively removed therefrom; and a cap that is supported by upper ends of the first and second side walls, wherein the cap encloses the rigid panels and the plurality of shelves between a bottom surface of the cap and the base when in the stowed position.

4. The collapsible shelving unit of claim 3 wherein the cap comprises a single rigid panel.

5. The collapsible shelving unit of claim 4 wherein the cap is pivotally connected to each of the first and second side walls.

6. The collapsible shelving unit of claim 3 wherein the cap is comprised of a plurality of rigid cap panels that are movably connected to each other and wherein the rigid cap panels are pivotally movable relative to the first and second side walls.

7. The collapsible shelving unit of claim 1 wherein the support base comprises a bottom with a first rigid side portion extending upwardly from one side of the bottom and a second rigid side portion extending upwardly from an opposite side of the bottom, and wherein the first side wall connects to the first rigid side portion and the second side wall connects to the second rigid side portion.

8. The collapsible shelving unit of claim 7 wherein the first and second rigid side portions are integrally formed with the bottom as one-piece.

9. The collapsible shelving unit of claim 7 wherein the first and second rigid side portions are defined by a base height and wherein the rigid panels are defined by an overall side wall height when in the stowed position, and wherein the base height is greater than or equal to the overall side wall height when in the stowed position.

10. The collapsible shelving unit of claim 9 including a cap supported by upper ends of the first and second side walls when in the display position and which is supported by the first and second rigid side portions when in the stowed position such that the plurality of shelves and the first and second side walls are completely enclosed within a space between the cap and the support base.

11. The collapsible shelving unit of claim 9 wherein the plurality of shelves are removed from the first and second side walls and are stacked on the bottom prior to moving the rigid panels to the stowed position such that the base height is greater than or equal to a height of stacked shelves plus the overall height side wall height when in the stowed position.

12. The collapsible shelving unit of claim 1 wherein rigid panels of the first side wall overlap each other and rigid panels of the second side wall overlap each other when in the stowed position, and wherein rigid panels of the first side wall do not overlap rigid panels of the second side wall when in the stowed position.

13. The collapsible shelving unit of claim 1 wherein the rigid panels of the first side wall overlap each other and the rigid panels of the second side wall overlap each other when in the stowed position, and wherein the rigid panels of the first side wall overlap the rigid panels of the second side wall when in the stowed position.

14. A collapsible shelving unit comprising:

a support base;

a first side wall extending upwardly from one side of said base;

a second side wall extending upwardly from an opposite side of said base, wherein each of said first and second side walls are comprised of a plurality of rigid panels connected to each other with at least one hinge such that the rigid panels are moveable between a display position where the panels extend vertically to form the first and second side walls and a stowed position wherein at least two of the rigid panels at least partially overlap each other, and wherein the at least one hinge comprises at least one slidable hinge;

a plurality of shelves supported by the first and second side walls such that the shelves can be selectively removed therefrom; and wherein adjacent ones of the rigid panels are selectively locked together with at least one lock component that comprises at least one pressable latch that includes a resilient protruding body that snaps into an opening to provide a locked configuration and wherein the resilient protruding body is pressed inwardly to release the resilient protruding body from the opening to unlock the latch.

15. The collapsible shelving unit of claim 1 wherein at least two of the rigid panels from each of the first and second side walls include slots that slidably receive sliding edges of the shelves, and wherein the slots are spaced apart from each other in a vertical direction such that each rigid panel of the at least two of the rigid panels is configured to support at least two shelves.

16. The collapsible shelving unit of claim 1 including a back panel that removably attaches to the first and second side walls when in the display position.

17. The collapsible shelving unit of claim 16 including a front panel that removably attaches to the first and second side walls when in the display position such that goods supported by the shelves are completely enclosed within the shelving unit during shipping.

18. The collapsible shelving unit of claim 1 wherein a bottom surface of the base includes a stacking feature that cooperates with a corresponding stacking feature on a second collapsible shelving unit such that the base can be stacked on the second collapsible shelving unit to allow stacked collapsible shelving units to be moved together without the base sliding off of the second collapsible shelving unit.

19. A collapsible shelving unit comprising:

a support base comprising a bottom with a first rigid side portion extending upwardly from one side of the bottom and a second rigid side portion extending upwardly from an opposite side of the bottom;

a first vertical support associated with the first rigid side portion;

a second vertical support associated with the second rigid side portion, wherein each of said first and second vertical supports are comprised of a plurality of collapsible members connected to each other such that each collapsible member is moveable between a display position where the collapsible members extend vertically to form the first and second side vertical supports and a stowed position wherein the collapsible members overlap each other for storage purposes; and, wherein the plurality of collapsible members comprise a plurality of rigid panels that are connected to each other with at least one slidable hinge to move the rigid panels between the display position and the stowed position; and a plurality of shelves supported by the first and second vertical supports.

20. The collapsible shelving unit of claim 19 wherein the slidable hinge comprises a plurality of first hinge portions on one of the rigid panels and a plurality of second hinge portions on another of the rigid panels that slidably and pivotably connect to the first hinge portions such that the first hinge portions are interspaced with the second hinge portions in an alternating arrangement to allow the one rigid panel to pivot relative to the other rigid panel.

21. The collapsible shelving unit of claim 19 wherein the at least one slidable hinge comprises at least one first slidable hinge that connects one rigid panel to another rigid panel and at least one second slidable hinge, and wherein the plurality of rigid panels includes a lower panel that slides on the at least one second slidable hinge that connects the lower panel to one of the first and second rigid side portions.

22. The collapsible shelving unit of claim 21 wherein the at least one second slidable hinge includes a pin in at least one lower leg portion of the lower panel, and wherein the lower leg portion is received in a corresponding receptacle of the rigid side portion, and wherein each receptacle includes a slot that slidably receives the pin to allow the lower panel to be slid upwardly.

23. The collapsible shelving unit of claim 19 wherein adjacent rigid panels are selectively locked together with at least one pressable latch, and wherein at least one lower panel of the plurality of rigid panels is attached to at least one of the first and second rigid side portions with another pressable latch, and wherein each pressable latch includes a resilient protruding body that snaps into an opening to provide a locked configuration and wherein the resilient protruding body is pressed inwardly to release the resilient protruding body from the opening to unlock the latch.

24. The collapsible shelving unit of claim 19 wherein each shelf includes an upper surface and a lower surface facing opposite the upper surface, and wherein each shelf includes a protrusion formed in one of the upper and lower surfaces and a corresponding recess formed within the other of the upper and lower surfaces such that the recess on one shelf receives the protrusion on an adjacent stacked shelf when in the stowed position.

25. The collapsible shelving unit of claim 1 wherein the slidable hinge comprises a plurality of first hinge portions on one of the rigid panels and a plurality of second hinge portions on another of the rigid panels that slidably and pivotably connect to the first hinge portions such that the first hinge portions are interspaced with the second hinge portions in an alternating arrangement to allow the one rigid panel to pivot relative to the other rigid panel.

26. The collapsible shelving unit of claim 1 wherein each of the first and second side walls includes a lower rigid panel that slides on the at least one slidable hinge that connects the lower panel to a respective rigid side portion of the support base.

27. The collapsible shelving unit of claim 26 wherein the slidable hinge includes a pin in at least one lower leg portion of the lower panel, and wherein the lower leg portion is received in a corresponding receptacle of the rigid side portion, and wherein each receptacle includes a slot that slidably receives the pin to allow the lower panel to be slid upwardly.

28. The collapsible shelving unit of claim 1 wherein adjacent ones of the rigid panels are selectively locked together with at least one pressable latch, and wherein at least one lower panel of the plurality of rigid panels is attached to at least one rigid side portion of the support base with another pressable latch, and wherein each pressable latch includes a resilient protruding body that snaps into an opening to provide a locked configuration and wherein the resilient protruding body is pressed inwardly to release the resilient protruding body from the opening to unlock the latch.

29. The collapsible shelving unit of claim 1 wherein each shelf includes an upper surface and a lower surface facing opposite the upper surface, and wherein each shelf includes a protrusion formed in one of the upper and lower surfaces and a corresponding recess formed within the other of the upper and lower surfaces such that the recess on one shelf receives the protrusion on an adjacent stacked shelf when in the stowed position.

30. The collapsible shelving unit of claim 2 wherein, when in the stowed position, the plurality of shelves are stacked within the support base with the plurality of rigid side panels being collapsed on top of the shelves and enclosed by the cap to form a first collapsed complete shelving unit, and wherein a bottom surface of the support base includes one of a recess or rail that cooperates with another recess or rail on a second cap of a second collapsed complete shelving unit such that the support base can be stacked on the second collapsed complete shelving unit to allow first and second stacked collapsed complete shelving units to be moved together without the base of the first collapsed complete shelving unit sliding off of the second cap of the second collapsed complete shelving unit.

31. The collapsible shelving unit of claim 14 wherein the rigid panels move in a vertical direction when between the display position and the stowed position, and wherein the resilient protruding body is pressed a direction transverse to the vertical direction to release the resilient protruding body from the opening.

* * * * *